US005848940A

United States Patent [19]

Yamada

[11] Patent Number: 5,848,940

[45] Date of Patent: Dec. 15, 1998

[54] PLAYGROUND

[75] Inventor: Masao Yamada, Akishima, Japan

[73] Assignee: Tamapak Co., Ltd., Tokyo, Japan

[21] Appl. No.: 679,557

[22] Filed: Jul. 12, 1996

[30] Foreign Application Priority Data

Jul. 12, 1995 [JP] Japan ..... 7-175708
Oct. 19, 1995 [JP] Japan ..... 7-261368

[51] Int. Cl.[6] ..... A63B 67/02

[52] U.S. Cl. ..... 473/151; 473/165; 473/390; 473/353; 473/351; 473/307; 473/325; 473/340

[58] Field of Search ..... 473/160, 169, 473/171, 157–159, 162–168; 273/167 J

[56] References Cited

U.S. PATENT DOCUMENTS

| | | | |
|---|---|---|---|
| 2,515,847 | 7/1950 | Winkler | 154/49 |
| 3,508,756 | 4/1970 | Bedford, Jr. | 473/160 |
| 3,658,343 | 4/1972 | Rogers et al. | 473/171 |
| 3,661,687 | 5/1972 | Spinney, Jr. et al. | 161/21 |
| 3,740,303 | 6/1973 | Alderson et al. | 473/171 |
| 4,161,558 | 7/1979 | See | 428/17 |
| 5,203,566 | 4/1993 | Ricigliano | 473/169 |

OTHER PUBLICATIONS

Lefler, "use of Synthetic Grass Grows in Sports Areas", The Washington Post, p. D7, Nov. 6, 1968.

*Primary Examiner*—Mark S. Graham
*Attorney, Agent, or Firm*—Elman & Associates

[57] ABSTRACT

A playground golf course with an artificial turf, the greens of which are formed by disposing a thin resilient urethane foam layer below the artificial turf so as to reduce golf ball bounce and hence roll on the artificial turf. Greens are formed by disposing a polyethylene buffer below the thin layer and disposing a green boundary edge member composed of an artificial turf belt member around the artificial turf. Greens are also formed by tensioning predetermined portions in the vicinity of the periphery of the artificial turf with springs. The playground golf course is formed by disposing a plurality of greens formed in such a manner in an existing athletic facility. The playground golf course is composed of the greens, a golf club with two club heads formed at both ends of a shaft, a golf ball with reduced flight characteristics, and a golf tee that allows players to easily hit golf balls.

17 Claims, 42 Drawing Sheets

PLAYGROUND

BACKGROUND OF THE INVENTION

1. Field of the Invention

The present invention relates to a playground capable of being quickly installed in a tennis court and which can be used day or night regardless of weather conditions, in particular, it relates to a playground that can be easily assembled at an existing sports facility such as a tennis court or an indoor athletic track that has low seasonal and diurnal temperature variation, and protection against snow, rain and inclement weather.

2. Description of the Related Art

When a golf player wants to play golf, he or she usually needs to go to an extensive golf course in a suburban or rural location. In addition, the playing time is long and the fee very high. These factors mean that many golfers can not play as much golf as they would like. In response, a small-scale golf course using existing indoor athletic facilities such as tennis courts has been proposed and practically used.

However, the foundations of existing athletic facilities are usually flat, being rolled soil or concrete, and most indoor sports facilities have wooden floors. Thus, when a golf course is formed by placing artificial turf on such a foundation the golf ball bounces excessively when hit, making it difficult for the player to aim a ball at a desired place. In addition, when the player hits a golf ball, it often flies off in an unexpected directions.

SUMMARY OF THE INVENTION

The present invention is made with the above-described considerations in mind. One objective of the present invention is to provide a golf course that can be formed on an existing athletic facility in which golf ball travel is restricted by limiting ball bounce and roll. Another objective is to provide a golf course that has a variety of features such as an artificial turf that is resistant to wrinkling and the formation of indentations such as ruts that would inhibit the use of wheelchairs and hence the ability of the physically handicapped to play golf. A further objective of the present invention is to provide a golf ball that has limited flight characteristics and that is easily distinguished, a golf club that can be easily handled, and a golf tee that is useful for accurately driving golf balls.

To accomplish the above-described objectives, according to the present invention, the greens have artificial turf. A thin, resilient urethane foam layer is disposed below the artificial turf so as to reduce golf ball bounce and hence roll on the artificial turf. A green can also be formed by disposing a polyethylene foam buffer below the thin layer, disposing a green boundary edge composed of an artificial turf belt on the periphery of the artificial turf, and tensioning predetermined portions in the vicinity of the peripheral portion of the artificial turf with springs. A golf course is formed by disposing a plurality of such greens in an existing athletic facility.

Thus, the thin, resilient urethane foam layer inhibits golf ball roll on the artificial turf by reducing excessive bounce. The polyethylene foam disposed below the thin urethane layer also provides the golf player with a comfortable walking surface with sufficient resilience. The boundary edge of the green conceals the springs which tension the artificial turf, and enhances the "feel" of the green. In addition, the raised boundary edge effectively prevents golf balls from running off the green. The springs disposed at predetermined positions in the vicinity of the peripheral portion of the artificial turf cause the artificial turf to be tensioned, thereby preventing excessive expansion contraction and hence wrinkling of the artificial turf caused by seasonal and diurnal temperature variations.

DESCRIPTION OF THE PREFERRED EMBODIMENT

Figure 1:
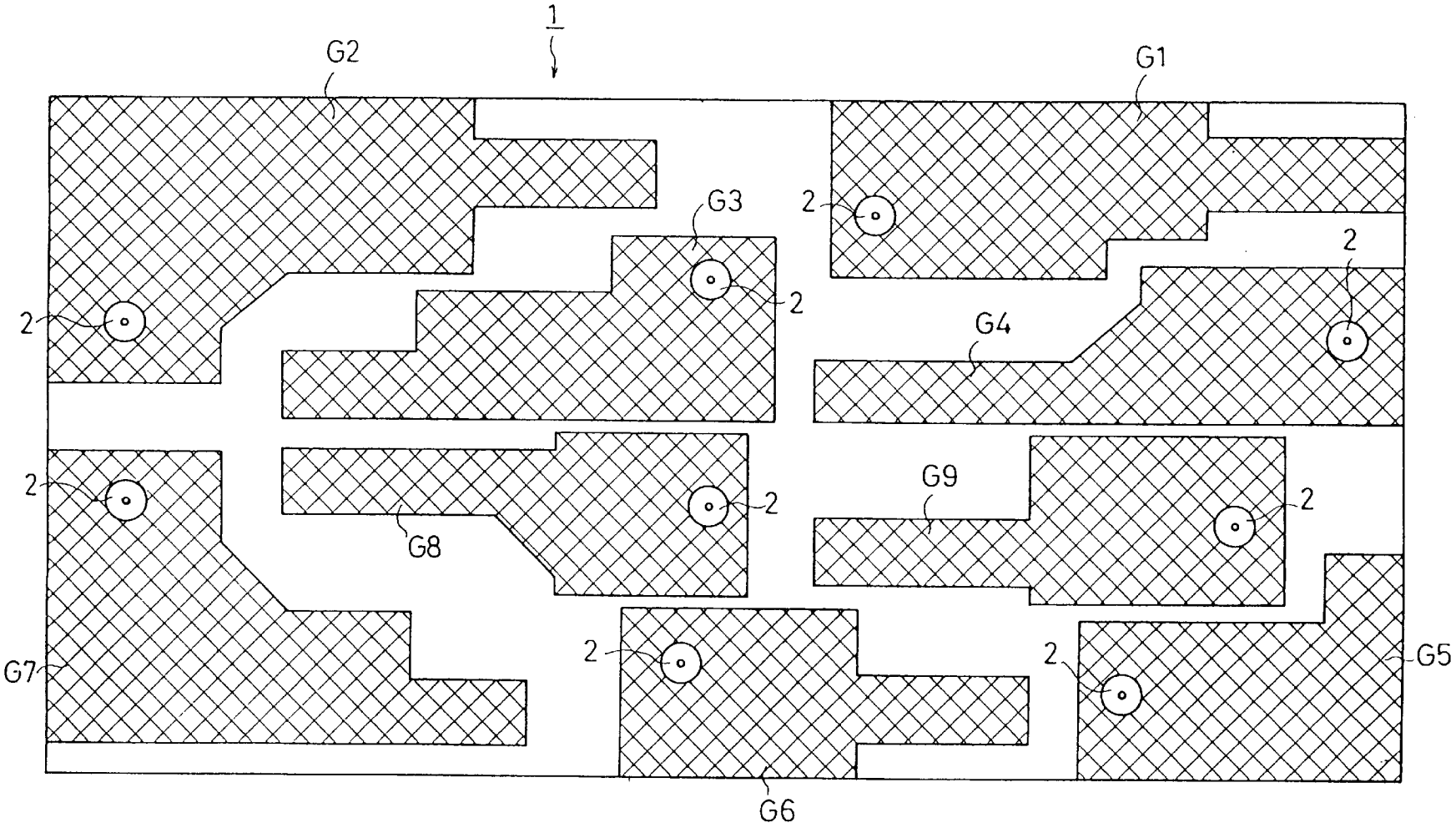
FIG. 1 is a plan view showing an example of a layout of a golf course according to the present invention.

FIG. 1 is a plan view showing an example of a layout of a golf course according to the present invention. In FIG. 1, a golf course 1 has nine greens G1, G2, G3, G4, G5, G6, G7, G8, and G9 in a rectangle about 30 m (long)×15 m (wide). Each green has a hole 2. A teeing ground (not shown) is disposed at the outer edge apart from the hole 2 or at an inner portion of the green. Players play games in the order of green G1, green G2, . . . , and on to green G9. By repeating the same course, players can play 18-hole games.

Figure 2:
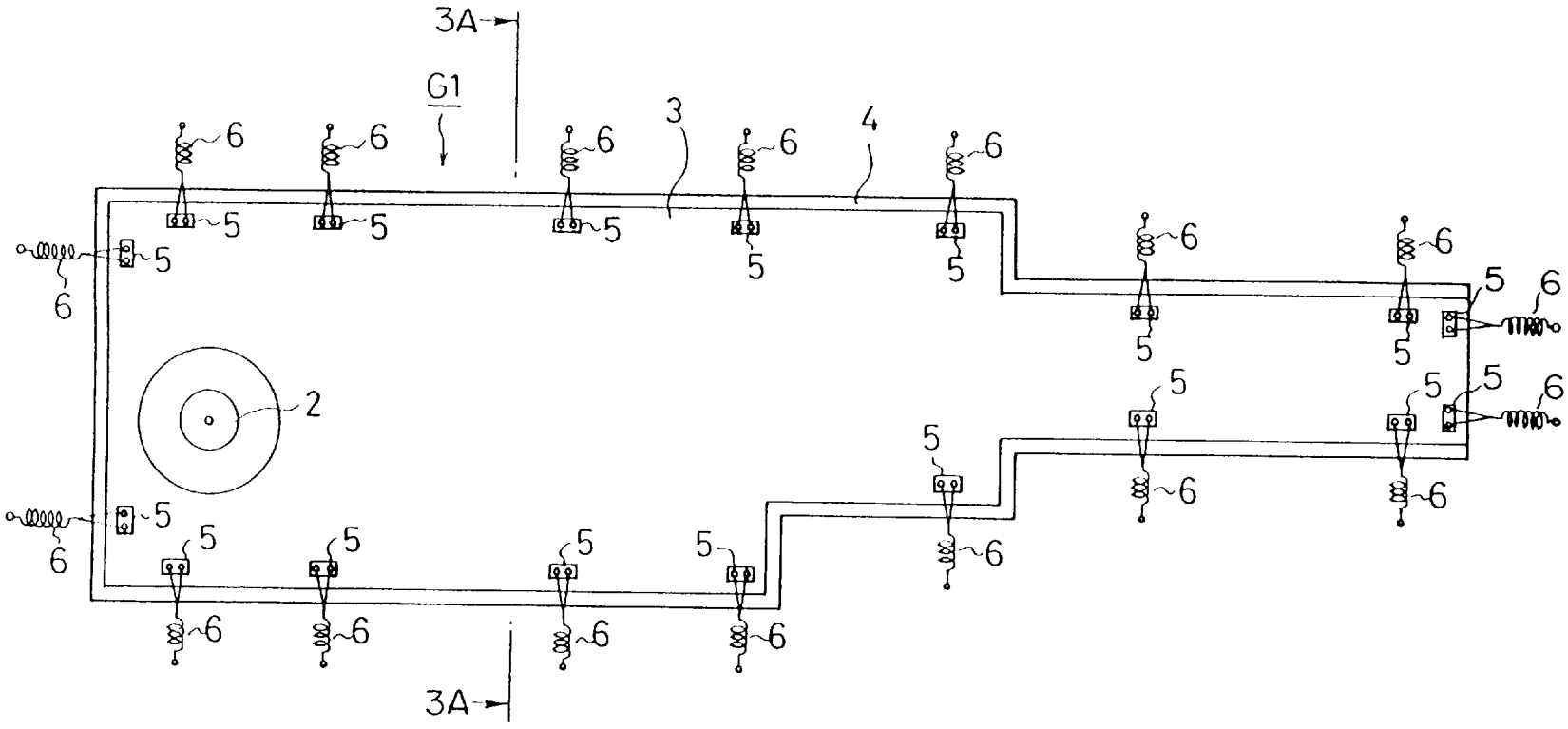
FIG. 2 is a plan view showing an example of a green G1 to explain detailed construction of a green.

FIG. 2 is a plan view showing green G1 to explain the detailed construction of a green. The maximum length and the maximum width of green G1 are around 15 m and around 3.6 m, respectively. The surface of the green is composed of artificial turf 3. A green boundary edge member 4 protrudes for around 40 mm. Pads 5 composed of metal or plastic sheet and leather or the like are disposed at predetermined positions in the vicinity of the periphery of the artificial turf 3. Each of the pads 5 has a pair of holes through which a string can be passed. The holes are preferably protected with eyelets.

For example, a vinyl rope is passed through the holes. Both ends of the rope are tied in a ring shape. One end of a spring 6 is hooked to one side of the ring and the other end of the spring 6 is properly tensioned and secured to the ground or the like with a fastener such as a nail. When the artificial turf 3 is equally tensioned by the springs 6, the surface of the artificial turf 3 is prevented from wrinkling. Should the artificial turf 3 get wrinkled when the edge portion thereof is patted with a hand, the wrinkles will immediately disappear. The springs 6 may be substituted for appropriate ones depending on the weather conditions. That is, in seasons with large diurnal temperature variations, larger springs with a length of around 10 cm should be used. In a seasons in which diurnal temperature variations are small, shorter springs with a length of around 5 cm should be used. In FIG. 2, the springs 6 are extended from the vicinity of the boundary edge 4 of the green so that they can be easily distinguished. However, when the green is actually formed, springs 6 are concealed by the boundary edge 4 for good appearance. When the springs 6 are coated with a rust-proofing agent such as epoxy urethane resin or when stainless steel springs are used, the durability thereof is improved and they can be used for a long time. Alternatively, instead of the springs 6, rubber belts, elastic plastic (soft plastic) belts, rubber rods, or elastic plastic rods may be used. The tensioning means such as the springs 6 and rubber belts for the artificial turf 3 can be used for indoor tennis courts, badminton courts, or other facilities as well as for the playground golf course.

Figure 3A:
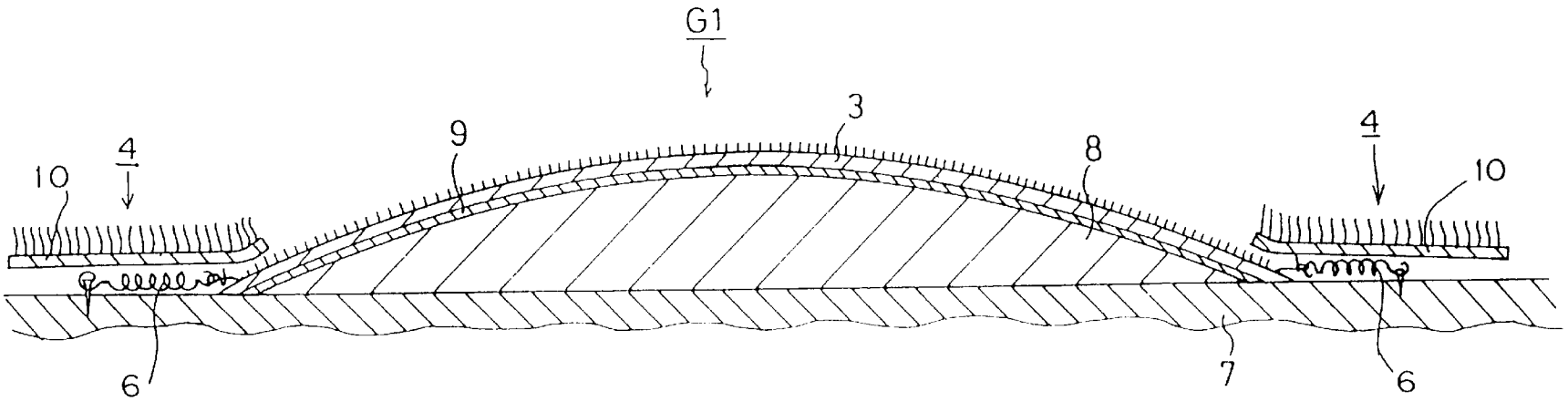
FIG. 3A is an outlined sectional view taken along line X—X of FIG. 2.

FIG. 3A is an outlined sectional view taken along line X—X of FIG. 2. In FIG. 3A, a base layer 8 is disposed as the lowest layer of the green. The base layer 8 contacts the foundation (ground or floor) 7. The base layer 8 is composed of a resilient buffer such as polyethylene or polypropylene foam. Thus, even if a physically handicapped person traverses the green with his or her wheelchair, ruts do not form. The maximum thickness of the base layer member 8 is preferably from around 4 cm to 8 cm. However, in the embodiment, the maximum thickness of the base layer member 8 is around 4 cm. Referring to FIG. 3A, the base layer member 8 has a cambered surface. However, most of the upper surface of the base layer 8 may be flat and the vicinity of both edge portions may be formed in a gentle slope. Thus, the section of the base layer 8 may be formed in a trapezoidal shape. Alternatively, the base layer 8 may be formed with a constant thickness and disposed on the foundation into it so that the boundary edge 4 of the green has the greatest height. Alternatively, the base layer 8 may be composed of hard sponge rubber. If relatively cheap styrofoam is used for the base layer 8, it tends to crack. In addition, since such styrofoam is not resilient, it is not suitable base layer material. On the other hand, unlike styrofoam, polypropylene foam has excellent resilience, and if dented, quickly restores itself to its original shape.

A thin layer 9 composed of urethane foam is disposed on the upper surface of the base layer 8. The thin layer 9 composed of urethane foam is very effective in inhibiting golf ball roll on the artificial turf 3 disposed on the thin layer 9, as it significantly dampens golf ball bounce. The thickness of the thin urethane foam layer 9 should be from 4 mm to 8 mm, and preferably in the range from 4 mm to 6 mm, as when the thickness of the thin layer 9 composed of urethane foam is increased excessively, it imparts an unnatural "feel" to the artificial turf. In contrast, when the thickness of the thin layer 9 composed of urethane foam is too thin, it becomes difficult to handle and hence to fabricate the thin layer 9. In the embodiment, urethane foam is used as the material of the thin layer 9. However, rubber (sponge rubber), sponge-like tissue, plastic foam or other resilient materials may be used.

As described above, the artificial turf 3 is disposed on the thin layer 9 composed of urethane foam. In this embodiment, an impermeable artificial turf is used as the artificial turf 3. When a permeable artificial turf is used, an impermeable sheet should be disposed between the artificial turf 3 and the thin urethane foam layer 9.

The boundary edge 4 of the green is composed of an artificial turf belt (a belt composed of artificial turf) 10 with a width of from 25 cm to 50 cm. The boundary edge 4 is disposed around of the periphery of the green. The artificial turf belt 10 conceals the springs 6. Although the boundary edge 4 of the green is not disposed at the entrance to the green as shown in FIG. 2, it may be disposed at this portion if desired.

Figure 3B:
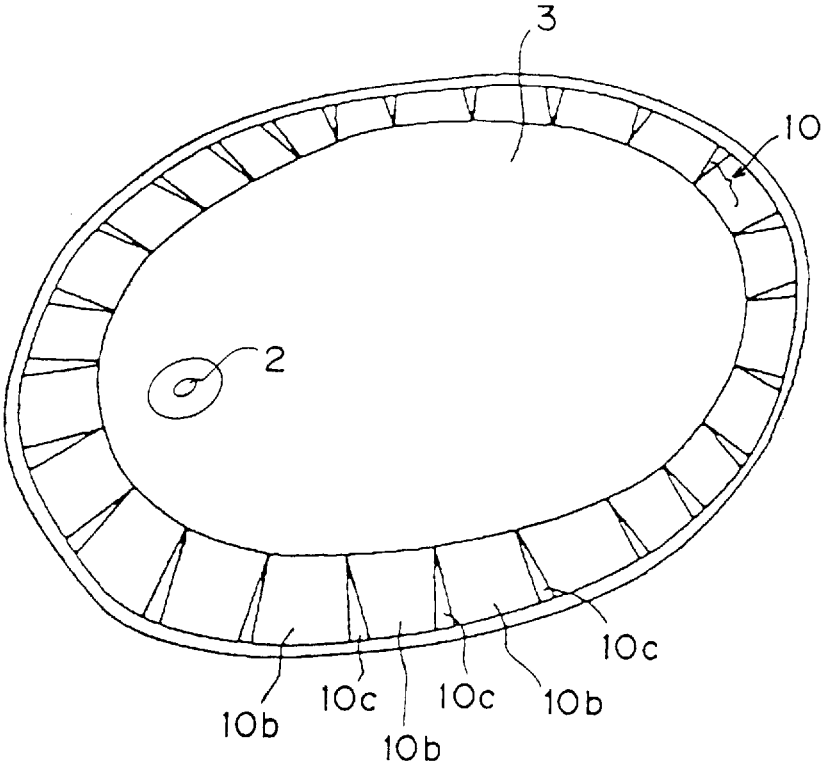
FIG. 3B is a plan view of a green as an example of forming a green not in a rectangular shape but in a circular or an oval shape.

FIG. 3B is a plan view of a green not in a rectangular shape but in a circular or oval shape. The artificial turf belt 10 is formed by sequentially fixing a primary rectangular portion 10*b* and a secondary triangular portion made of artificial turf to the portion surrounding the green. FIG. 3A shows the case where the thickness of the artificial turf 3 is smaller than the thickness of the artificial turf belt 10. It is obvious that the thickness of the artificial turf belt 10 can be designed to be equal to or smaller than the thickness of the artificial turf 3.

Figure 3C:
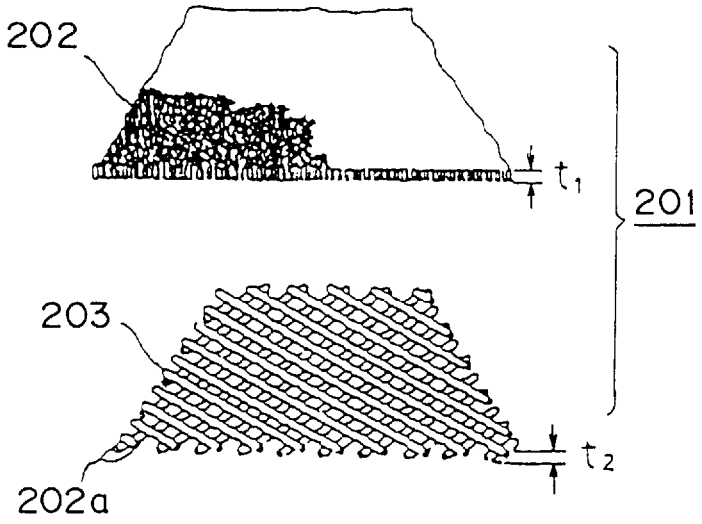
FIG. 3C is a general oblique view showing the configuration of the substructure of a green.

FIG. 3C is a general oblique view showing the configuration of the substructure that can be substituted for the base layer 8 and thin layer 9 forming the green G1. In FIG. 3C, a substructure 201 comprises a synthetic fiber mat 202 and a restorable material 203. The synthetic fiber mat 202 is, for example, a non-woven fabric of polyester fiber, and its thickness t1 is about 10mm. It has excellent water-permeability and is corrosion-resistant. Therefore, the water from the above artificial turf drains away downward to prevent the entire structure from corroding even if the entire structure is soaked with water for a long time.

The above described restorable material 203 is fixed under the synthetic fiber mat 202, and is formed by laminating foam resin materials 202*a* in a mesh form with each intersection welded.

The foam resin material 202*a* is a foam polypropylene pole. It is quickly transformed upon receipt of an external force in the thickness direction, and gradually recovers its original form. Since the foam resin material 202*a* is laminated in a mesh foam with each of the intersections welded, the water passing downward through drain holes can be further led downward when the permeable artificial turf 3 is provided without an impenetrable sheet thereunder. Furthermore, the foam resin material 202*a* suppresses the ball falling in the artificial turf from bouncing up through its cushion effect, and reduces the load to the feet and waist of the player.

The thickness t2 of the restorable material 202 is set to about 10 mm when the material is used for a putting green in a golf playground. The thickness can be adjusted depending on the resiliency of a ball and the contents of a game.

Since fixing the restorable material 203 and synthetic fiber mat 202 using adhesives containing a thinner is harmful to the material such as polypropylene, etc., it is recommended to use water-soluble adhesives or adhesive compounds.

Figure 3D:
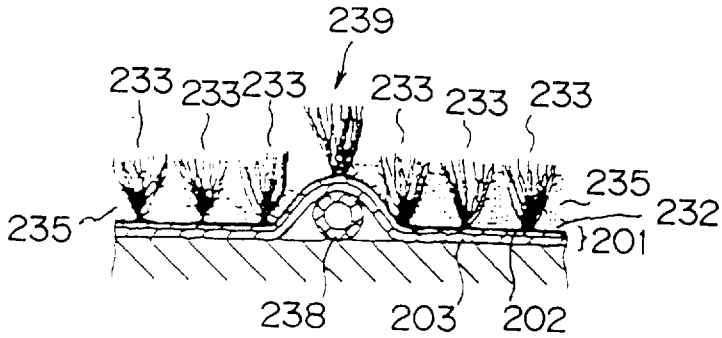
FIGS. 3D and 3E are partial sectional views showing putting greens.
Figure 3E:
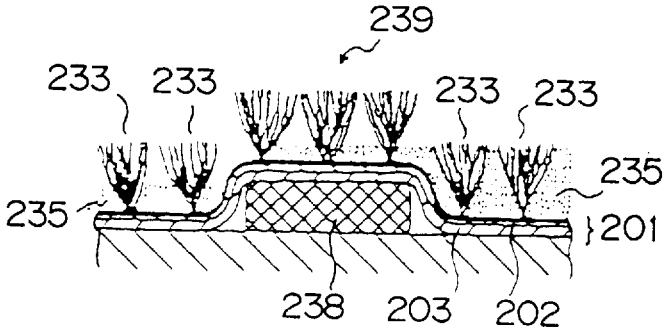
Figure 3G:
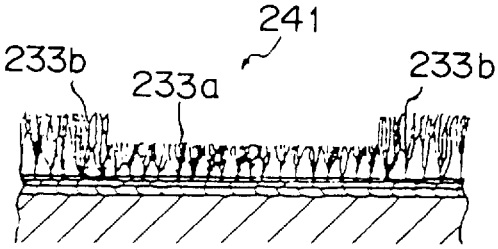
FIG. 3G is a partial sectional view showing another putting green.
Figure 3F:
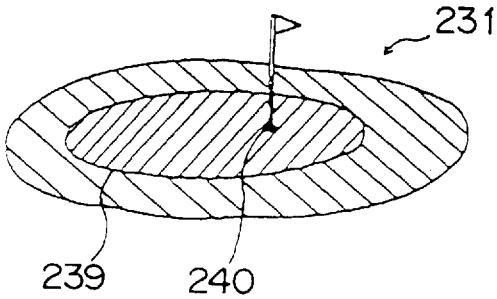
FIG. 3F is a general oblique view showing the entire green.

FIG. 3D is a partial sectional view showing a putting green to be properly applied onto the above described substructure. FIG. 3F is a general oblique view showing the entire green 231. In FIGS. 3D and 3F, the green 231 is covered with artificial turf produced by planting a permeable polypropylene or synthetic rubber base fabric 232 with grasses 233. Under the substructure 201, a supporter, that is, an intermediate material 238, for example, vinyl chloride pipe (FIG. 3D), plate (FIG. 3E), etc., for making a part of the base fabric 232 of the artificial turf convex is provided. For example, a circular, oval, or any other shape of green area is formed on the green 231 as shown in FIG. 3F. A convex undulation 239 is formed by the intermediate material 238 around the circumference of the green area. Particulate substances (sand) 235 laid on the green 231 vary in thickness between the inside and outside of the green area. There is a hole 240 provided in the green area. The above described artificial turf of the putting green can be pulled by a spring at the circumference as in the green shown in FIG. 2. FIG. 3G is a partial sectional view showing another putting green applicable onto the above described substructure. In FIG. 3G, the configuration of the artificial turf and its substructure is generally the same as that of the above described embodiment. The grasses 233*a* of the artificial turf as the green area 241 are shorter than the grasses 233*b* of the artificial turf as the area surrounding the green area 241. For example, the grasses 233*a* is about 255 mm long while the grasses 233*b* are 30 mm through 35 mm long. In this example, the sand laid on the green can vary in thickness between the green area 241 and the area outside the green area 241. However, these area can be distinguished by the difference in grass length of the grasses 233*a* and 233*b*, and the thickness of the sand can be constant.

Figure 4C:
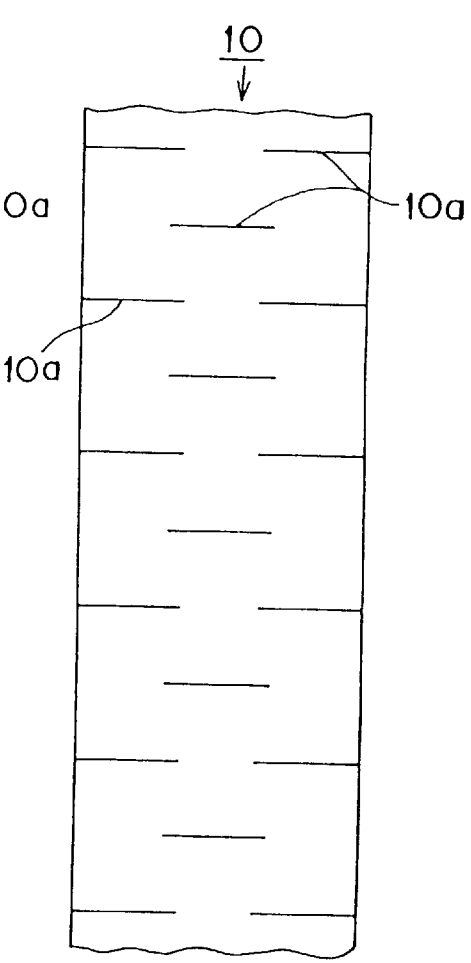
FIGS. 4A, 4B, and 4C are partial outlined rear views of an artificial turf member 10.
Figure 4B:
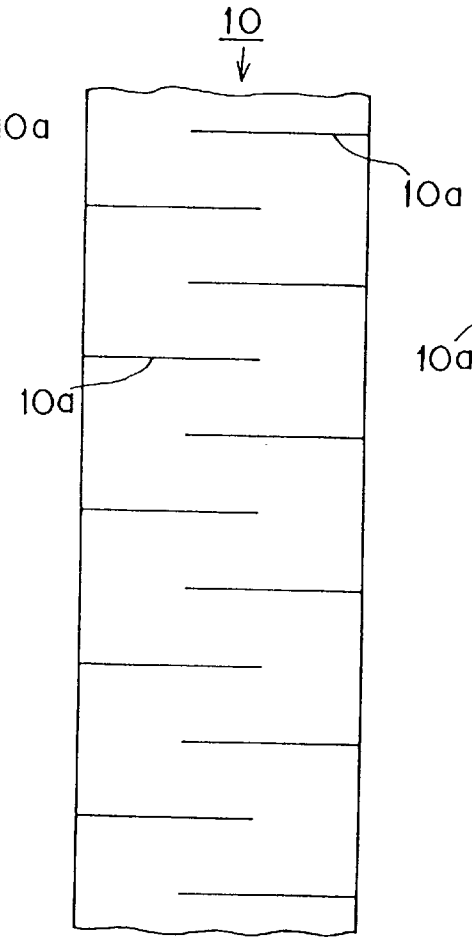
Figure 4A:
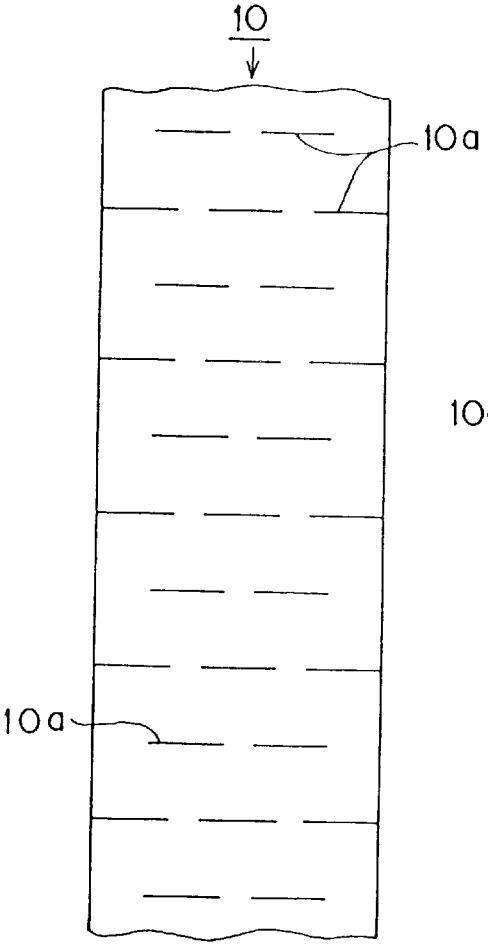

FIGS. 4A, 4B, and 4C are partial outlined rear views showing examples of the artificial turf 10. In these drawings, cut portions 10*a* are regularly formed on a base portion of the artificial turf belt 10. Unless the cut portions 10*a* are formed, the front surface of the artificial turf belt 10 may buckle or warp due to temperature and humidity changes, thereby becoming awkward to play on. However, when the cut portions 10*a* are regularly formed, they look like a pattern and prevent the other portions from buckling or warping.

Figure 5:
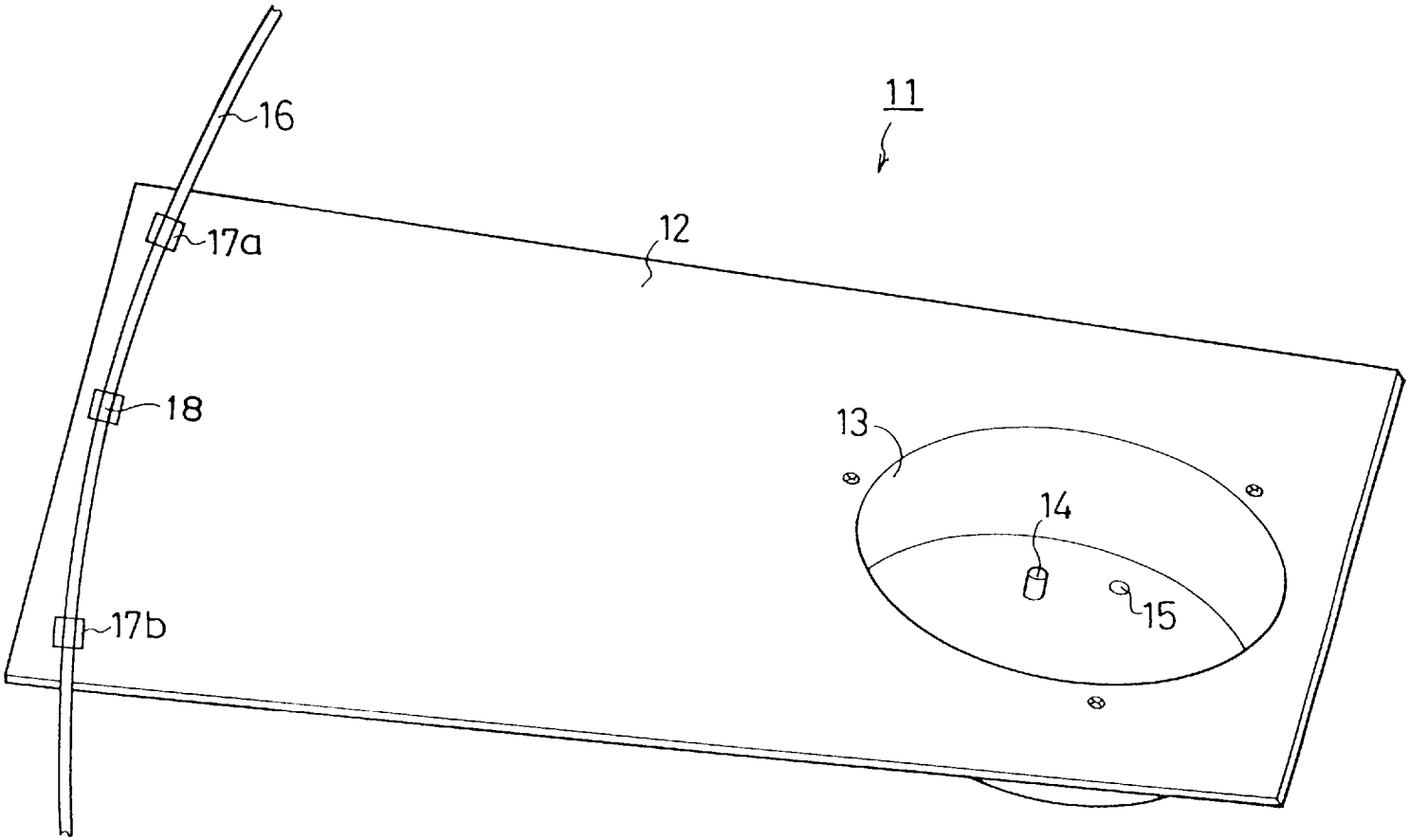
FIG. 5 is an outlined perspective view showing a member that forms a hole 2.

FIG. 5 is an outlined perspective view showing a member that forms a hole 2. In FIG. 5, the member 11 has a flat plate member 12 and a cylindrical member 13 that faces a hole formed on one side of the flat plate 12. The length to width ratio of the flat plate 12 is preferably around 1 to 3.5. In the embodiment, it is around 54 cm long, the width of the side close to the cylindrical member 13 is around 14 cm, and the length of the side opposite thereto is around 17 cm. Thus, the planar shape of the flat plate 12 is an inverse trapezoid, the length of which increases from the side close to the cylindrical member 13 (on the right hand side of the drawing) to the side opposite thereto (on left hand side of the drawing).

Member 13 is cylindrical with a flat bottom portion at one end and a flanged opening at the other. The flange portion has three equidistant screw holes drilled in it. The opening of the cylindrical vessel 13 faces the hole of the flat plate member 12, and the cylindrical vessel 13 is screwed to the flat plate 12 the rough the holes in the flange. Nearly the center of the flat bottom portion of the cylindrical vessel 13, a protruding rod 14 that holds a pipe (an aluminum pipe or a plastic pipe) that functions as a flag pole, is integrally formed or secured with an adhesive material, a screw, or other means. In addition, a water drainage hole 15 is formed at the flat bottom portion of the cylindrical vessel 13 so as to prevent water from staying in the cylindrical vessel 13. The inner diameter of the cylindrical vessel 13 should be around 110 mm and the depth thereof should be around 40 mm.

Fastener portions 17*a* and 17*b* that fasten a linear member 16 functioning as a boundary line for distinguishing an OK zone (that will be described later) are formed in the vicinity of the vertical side furthest from the cylindrical vessel 13 of the flatplate 12. A hole 18 is formed in a position halfway between the fastener portions 17*a* and 17*b*. The hole 18 also causes a joint (that will be described later) of the linear member 16 to be installed in it.

Figure 6:
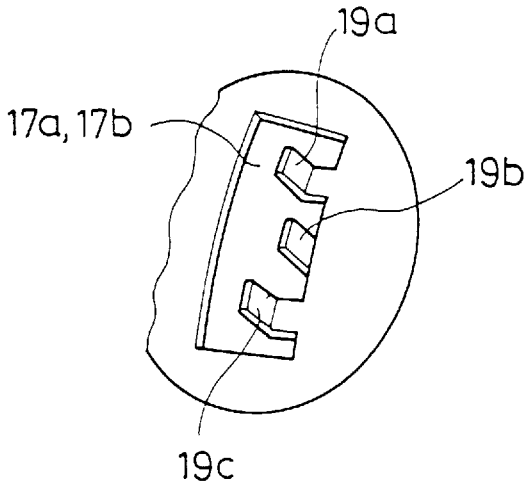
FIG. 6 is an enlarged partial outlined view showing detailed construction of fasteners 17*a* and 17*b;*

FIG. 6 is a partial outlined enlarged view showing the detailed construction of each of the fastener portions 17*a* and 17*b*. In FIG. 6, on one side of each of the fastener portions 17*a* and 17*b*, bent pieces 19*a*, 19*b*, and 19*c* are formed. The bent pieces 19*a* and 19*c* hold one peripheral surface of the linear member 16. The bent piece 19*b* holds the other peripheral surface of the linear member 16. In other words, the linear member 16 is surrounded and fastened by the bent pieces 19*a*, 19*b*, and 19*c*. Each of the fastener portions 17*a* and 17*b* has such a fastener.

Figure 7B:
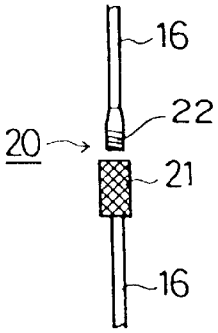
FIG. 7B is a partial plan view showing a joint 20 of the linear member 16.
Figure 7A:
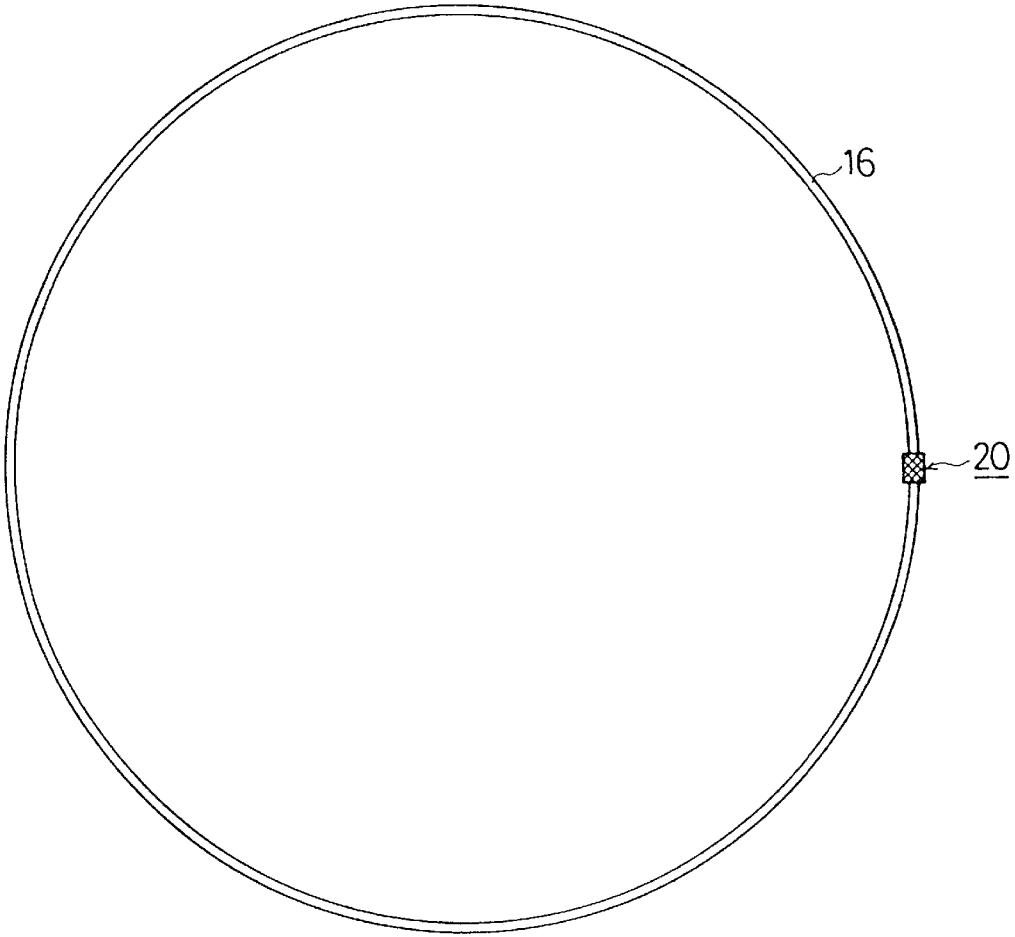
FIG. 7A is a plan view showing a linear member 16.

FIG. 7A is a plan view showing the linear member 16. FIG. 7B is a partial plan view showing a joint 20 of the linear member 16. Referring to FIGS. 7A and 7B, the linear member 16 is composed of a linear material such as a stiffish wire coated with a resin. The diameter of the linear material, including the resin layer, is around 2 mm.

A cylindrical member 21 with a length of around 10 mm and a diameter of around 6 mm is secured to one end of the linear member 16. The end of the cylindrical member 21 is closed with a bottom plate having a hole that allows the linear member 16 to pass through it. The outer wall of the cylindrical member 21 is indented. In addition, the inner wall of the cylindrical member 21 is threaded.

The end of the linear member 16 that passes through the hole of the bottom plate has a protrusion formed by melting the outer resin layer. The protrusion functions as a stopper to prevent the linear member 16 from passing through the hole in the bottom plate. In addition, a threaded member 22 screws into the threads of the cylindrical member 21 to secure it to the other end of the linear member 16. A cylindrical protrusion that fits to the end of the linear member 16 is formed at one edge of the screw member 22. Thus, by inserting the end of the linear member 16 into the cylindrical member 21 and turning it, the threaded member 22 is secured to the end of the linear member 16. The joint is thus composed of the cylindrical member 21 and the threaded member 22. When the linear member 16 is connected with the joint 20 to form a ring shape, the diameter thereof is around 80 cm. As described above, the linear member 16 also functions as the boundary line for distinguishing the above-mentioned OK zone. Next, the OK zone will be described in brief. To speed up a golf game, a particular region is designated around a hole (cup). When a golf ball enters and keeps into such a region, even if the ball does not enter the hole (cup), one stroke is added to the total number of strokes and the play for that particular hole is finished. This play method is called OK golf and has been proposed and used by the inventor of the present invention. Thus, the OK zone is a particular region designated around the hole (cup).

The hole forming member 11 is disposed just below the artificial turf 3 (or an impermeable sheet if permeable artificial turf is used). In other words, the artificial turf 3 has a hole corresponding to the opening of the cylindrical vessel 13 and holes corresponding to the fasteners 17*a* and 17*b*. In addition, the thin layer 9 and the base layer 8 have holes corresponding to the cylindrical vessel 13. The cylindrical vessel 13 is disposed of or buried so as to correspond to the holes in the thin layer 9 and the base layer 8. The ring-shaped linear member 16 is disposed around the cylindrical vessel 13 on the artificial turf 3. When part of the linear member 16 is secured with the bent pieces 19*a*, 19*b*, and 19*c*, the hole 2 and the OK zone can be formed. If necessary, a pipe or a vinyl tube is connected to the water drainage hole of the cylindrical vessel 1 so as to drain water to the soil.

Of course, a hole that does not have an OK zone can be formed for each green. In this case, a circular, rimmed cup member (like an inverted top hat) may be used. The depth of the hole should be from 50 mm to 60 mm. The diameter of the hole should be from 110 mm to 130 mm. The diameter including the brim, should be from 300 mm to 350 mm. The water, drainage hole may be formed in the same manner as in the hole forming member 11.

Figure 7C:
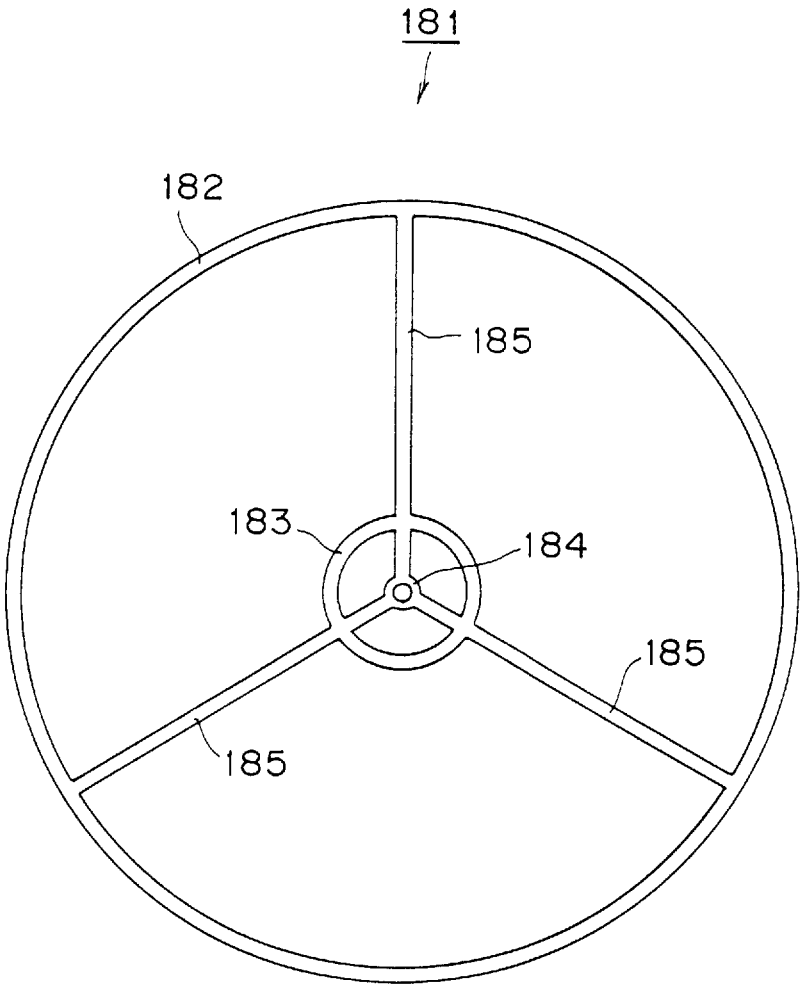
FIG. 7C is a plan view showing the structure of an OK zone to be provided when the OK zone is required.
Figure 17:
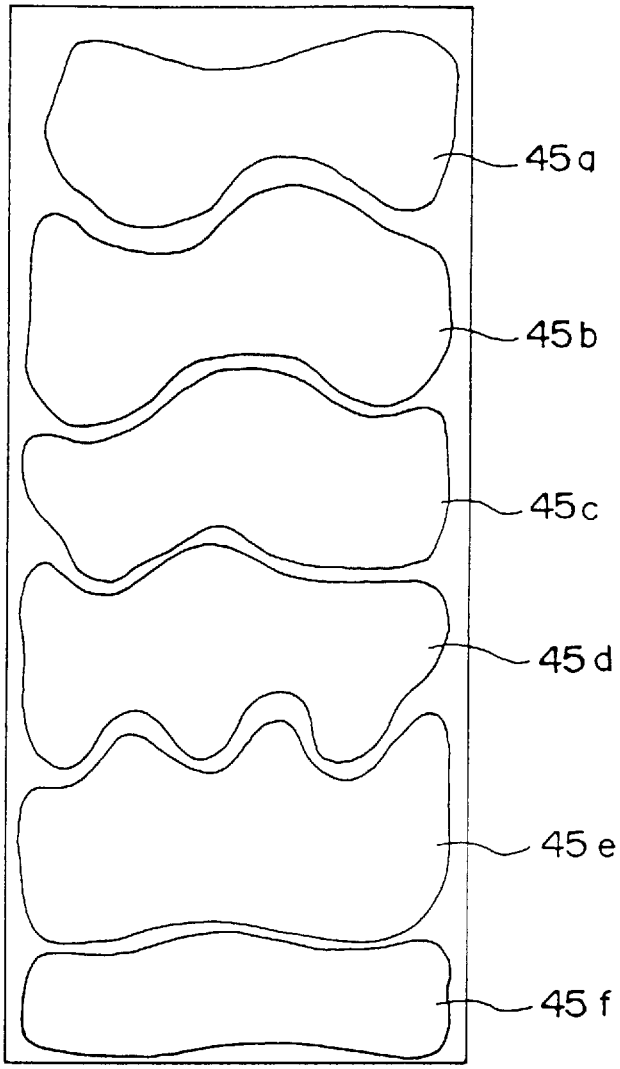
FIG. 17 is a plan view showing an example in which bunker or dummy pond members are cut from two sheets of artificial turf that are of the same size but different colors and that have been adhered to each other.

FIG. 7C is a plan view of an OK zone forming member substituted for the linear member shown in FIGS. 7A. In FIG. 7C, an OK zone forming member 181 comprises an outer circle 182 forming the outline of the OK zone area, an inner circle 183 surrounding the cup, and a center portion 184. The inner circle 183 and outer circle 182 are connected through the spoke supporter 185 extending radially from the center portion 184 in three directions. The OK zone forming member 181 can be efficiently and smartly produced by cutting a plate of iron, aluminum, stainless steel, or other metal or plastic material into a shape as shown in FIG. 7C. A golf ball falls into the cup through the area between the inner circle 183 and spoke supporter 185. If the spoke supporter 185 in the area may disturb the movement of the ball, then the width of the spoke supporter 185 should be made narrower than in FIG. 17C. The center portion 184 is designed to hold a flag. To actually hold a flag, the center portion 184 should be provided with a flag pole holder pipe for holding one end of the flag pole using screws and pins.

When the OK zone forming member 181 is used, the above described hole forming member is not required. Therefore, the hole forming member can be a cup with a circular brim or another type of cup having similar function.

Figure 8:
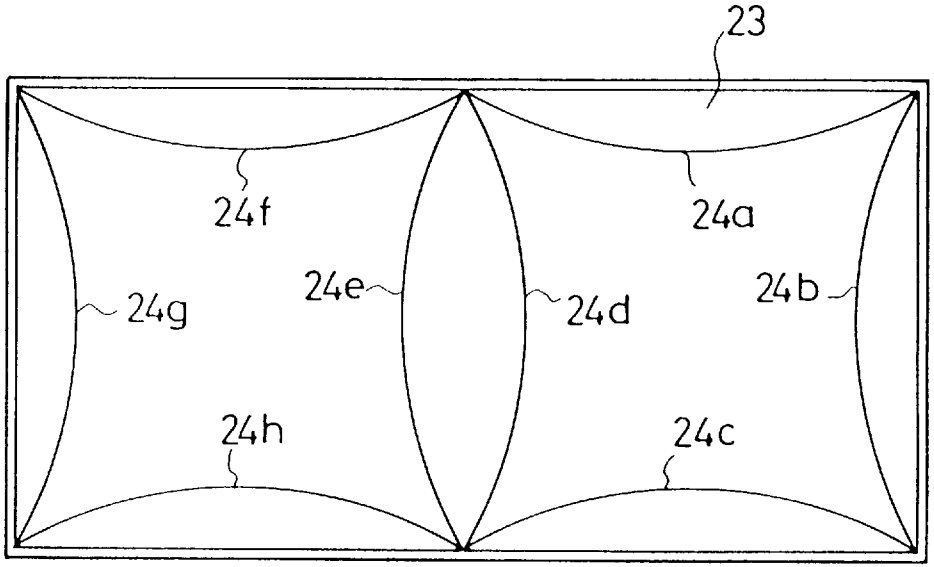
FIG. 8 is a schematic diagram showing the means used for tensioning artificial turf instead of the springs 6 shown in FIG. 2.

FIG. 8 is a schematic diagram for explaining the means of tensioning the artificial turf instead of using the springs 6 shown in FIG. 2. FIG. 8 shows the rear surface of the artificial turf 23. On the rear surface of the artificial turf 23, spring materials (for example, leaf springs) 24*a* to 24*h* are disposed at predetermined positions. In other words, needles for hook are disposed at both ends of each of the spring materials. The spring materials are properly bent in a bow shape. The needles for hook at both ends of the spring materials are directly inserted into the ground or secured with proper reinforcing materials. The number of spring materials used varies with the amount of wrinkling of the artificial turf and the shape of the green. The spring material is composed of a metal, synthetic resin, bamboo, or the like that provides similar tensioning to that of the spring 6.

Figure 9A:
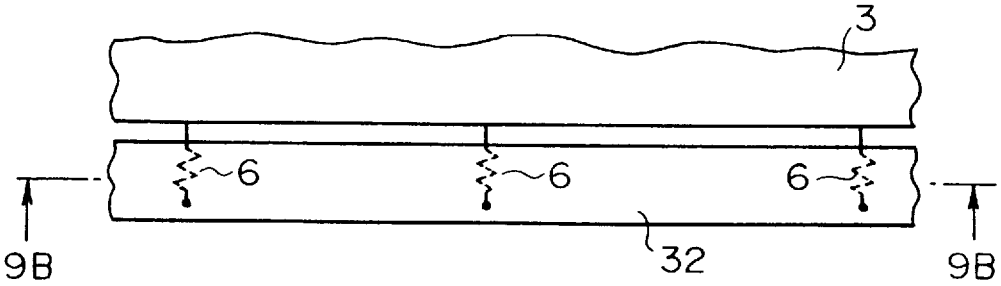
FIG. 9A is a partial outlined top view to show the disposition of the springs 6.
Figure 9B:
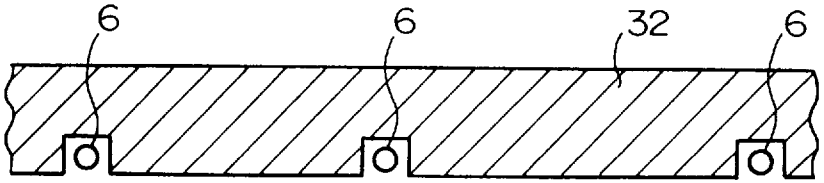
FIG. 9B is a sectional view taken along line A—A of FIG. 9A.

FIG. 9A is a partial outlined plan view for explaining the disposed positions of the springs 6. FIG. 9B is a sectional view taken along line A—A of FIG. 9A. As shown in FIGS. 9A and 9B, to conceal the springs 6 in the boundary edge member of the green, a block 32 composed of a resilient buffer (such as polypropylene foam or polyethylene foam) is disposed. The block 32 has cut portions that house the springs 6. In such a state, the artificial turf is disposed above the block 32. Thus, the boundary edge member is formed. The size of the block 32 is such as to conceal the springs 6.

Figure 10A:
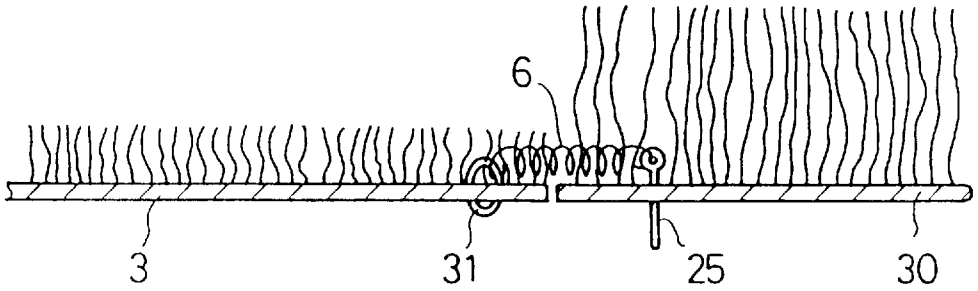
FIG. 10A is a partial side view showing an example of the artificial turf portion of the green when the springs 6 are concealed by artificial turf.
Figure 10B:
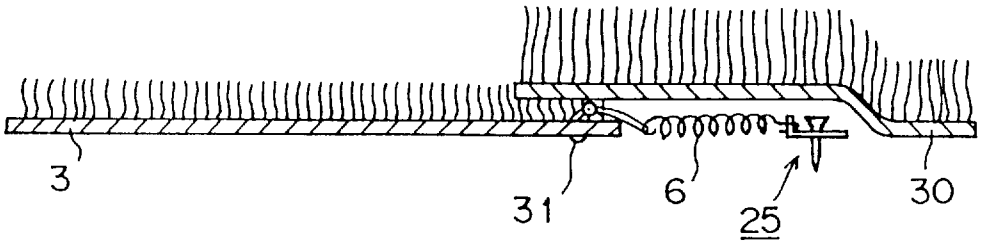
FIG. 10B is a partial side view showing another example of the artificial turf portion of the green when the springs 6 are concealed by the artificial turf.
Figure 10C:
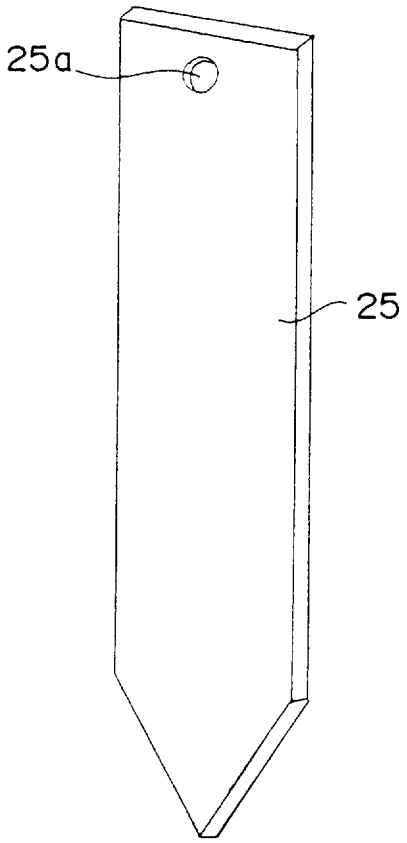
FIG. 10C is a general oblique view showing the configuration of a fastener.

FIG. 10A is a partial side view showing the artificial turf portion of the green in when the springs 6 are concealed in the artificial turf. In this embodiment, instead of the boundary edge of the green having the block 32, an artificial turf belt 30 that has a nap two or three times longer than that of the artificial turf 3 is used. One end of each of the springs 6 is secured to the artificial turf 3 through a hook 31. The other end of each of the springs 6 is secured to a stop member 25. The stop member 25 is inserted into the ground through the artificial turf 30. Thus, the springs 6 are secured along with the artificial turf 30. In this state, each of the springs 6 has a load of around 4 kg. As shown in FIG. 10(B), the artificial turf 30 may be disposed on top of the springs 6, the hooks 31, the stop member 25, and so forth. In addition, the artificial turf 30 may partially overlap with the artificial turf 3. This construction is the same as that of the green boundary edge 4 shown in FIG. 3. The artificial turf 30 may have the cut portions 10*a* shown in FIGS. 4A, 4B, and 4C. The stop member 25 can be a quasi-rectangular plate obtained by cutting an aluminum, stainless steel, brass, or other metal plate to have a sharp tip as shown in FIG. 10C. The sharp tip of the quasi-rectangular plate is driven into the ground with the upper portion of the plate left on the ground and with the other end of the spring 6 connected to the stop member 25*a*.

Figure 11A:
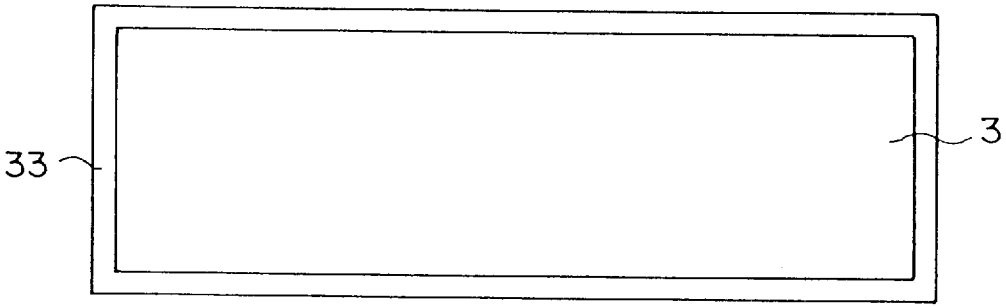
FIG. 11A is a plan view showing an example of a green formed in an indoor athletic facility.
Figure 11B:
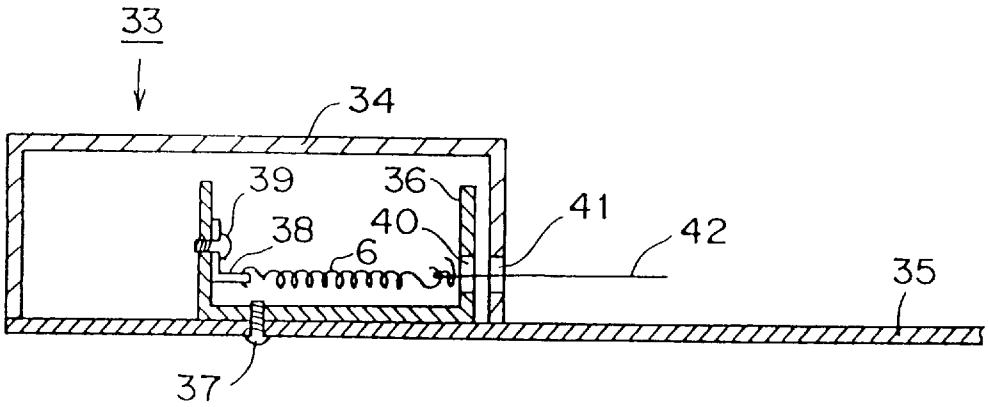
FIG. 11B is a partial enlarged sectional view showing a green including a boarder edge member 33.

FIG. 11A is a plan view showing an example of a green preferably formed on an indoor playground. In FIG. 11A, the construction of each of the artificial turf 3, the base layer 8, and the thin layer 9 are the same as that shown in FIG. 2. A boundary edge 33 is disposed in the periphery of the green. FIG. 11B is a partially enlarged sectional view showing the green including the boundary edge 33. A grooved member (channel bar) 34 formed in a bracket shape (flat-bottomed U-shape) is inversely disposed as the boundary edge 33. The grooved member 34 is composed of steel or aluminum channeling. A plate 35 composed of aluminum, steel, wood, or the like is disposed at the bottom of the green. In other words, the base layer 8, the thin layer 9, and the artificial turf 3 are disposed on the plate 35. The grooved member 34 is disposed in the periphery of the plate 35. Another grooved member 36 is disposed within the grooved member 34. The bottom of the grooved member 36 is secured to the plate 35 with screws 37. An L-shaped fastener 38 is secured to one side wall of the grooved member 36 with a screw 39, a pin, an adhesive agent, or other securing means. One end of the spring 6 is hooked to the L-shaped fastener 38. A hole 40 is formed on the other side wall of the grooved member 36. In addition, a hole 41 is formed on the side wall of the grooved member 34 opposite the hole 40. A linear member 42 composed of a string, a wire, or the like is secured to the other end of the spring 6. The linear member 42 is secured to the artificial turf 3 (not shown in FIG. 11B) through the holes 40 and 41 and a hook 43 (see FIG. 13A) (that will be described later). In a green with the above-described construction, the artificial turf can be tensioned by the springs 6 so as not to damage the floor plate. By disposing a plurality of such greens, a playground golf course as shown in FIG. 1 is formed. A plurality of holes for securing the grooved member 36 with the screws 37 should be formed along the axis of the springs 6 so that the securing position of the grooved member 36 and the plate member 35 can be selected and changed in accordance with the length of the springs 6. In addition, instead of the springs 6, rubber belts, elastic plastic belts, rubber rods, or elastic plastic rods may be used.

Figure 12B:
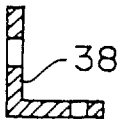
FIG. 12B is a vertical sectional view showing a center portion of FIG. 12A.
Figure 12A:
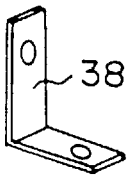
FIG. 12A is an outlined perspective view showing the construction of an L-shaped fastener 38.

FIG. 12A is an outlined perspective view showing the construction of the L-shaped fastener 38. FIG. 12B is a vertical sectional view showing the center portion of the L-shaped fastener 38. The L-shaped fastener 38 is formed by bending a plate composed of steel, aluminum, brass, or the like. Each of the bent surfaces of the L-letter shaped fastener 36 has a hole.

Figure 13A:
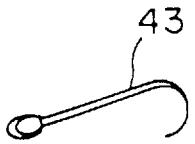
FIG. 13A is an outlined perspective view showing an example of a hook used to connect the spring 6 and the artificial turf 3.
Figure 13B:
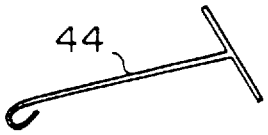
FIG. 13B is an outlined perspective view showing another example of the hook.

FIG. 13A is an outlined perspective view showing an example of a hook used to connect the spring 6 and the artificial turf 3. The hook 43 is formed in a fishhook shape that does not have a barb. The hook 43 has a hole at the blunt end so as to allow the linear member 42 to pass through it. FIG. 13B is an outlined perspective view showing another example of a hook. This hook 44 is composed of steel and formed in a T-shape. A hooking ring for hooking the linear member 42 is formed at the end of the shaft of the hook 44. An arm of the hook 44 functions as a stopper that fits into a peripheral portion of a hole in the artificial turf 3. The hook 43 and the hook 44 may be used when the greens (shown in FIGS. 2 and 3) of the playground golf course shown in FIG. 1 are formed.

Figure 14B:
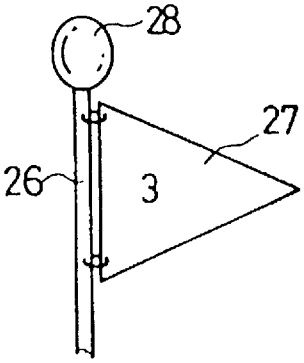
FIGS. 14B and 14C are outlined perspective views showing examples of body protecting members 29 disposed at the top of a pipe 26.
Figure 14C:
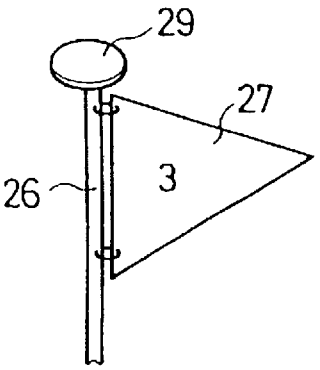
Figure 14A:
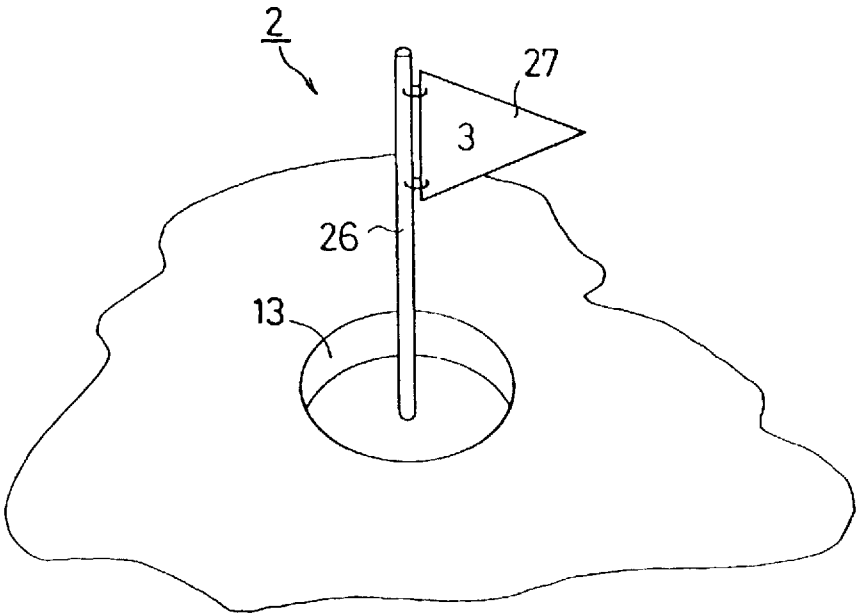
FIG. 14A is an outlined perspective view showing a flag pole in the hole 2.

FIG. 14A is an outlined perspective view showing a flag pole in the hole 2. The protrusion 14 in the cylindrical vessel 13 holds a pipe 26 that functions as the flag pole. The flag 27 is secured to the pipe 26 with a string or the like. When a spherical body protecting member 28 composed of a buffer material such as sponge rubber, polypropylene foam, or felt is disposed at the top of the pipe member 26 as shown in FIG. 14B, the spherical body member 28 at the tip of the pole will protect players falling down on the flag pole from getting hurt. Alternatively, a circular plate-shaped body protecting member 29 composed of rubber, polyethylene, or the like may be disposed at the top of the pipe 26.

Figure 15:
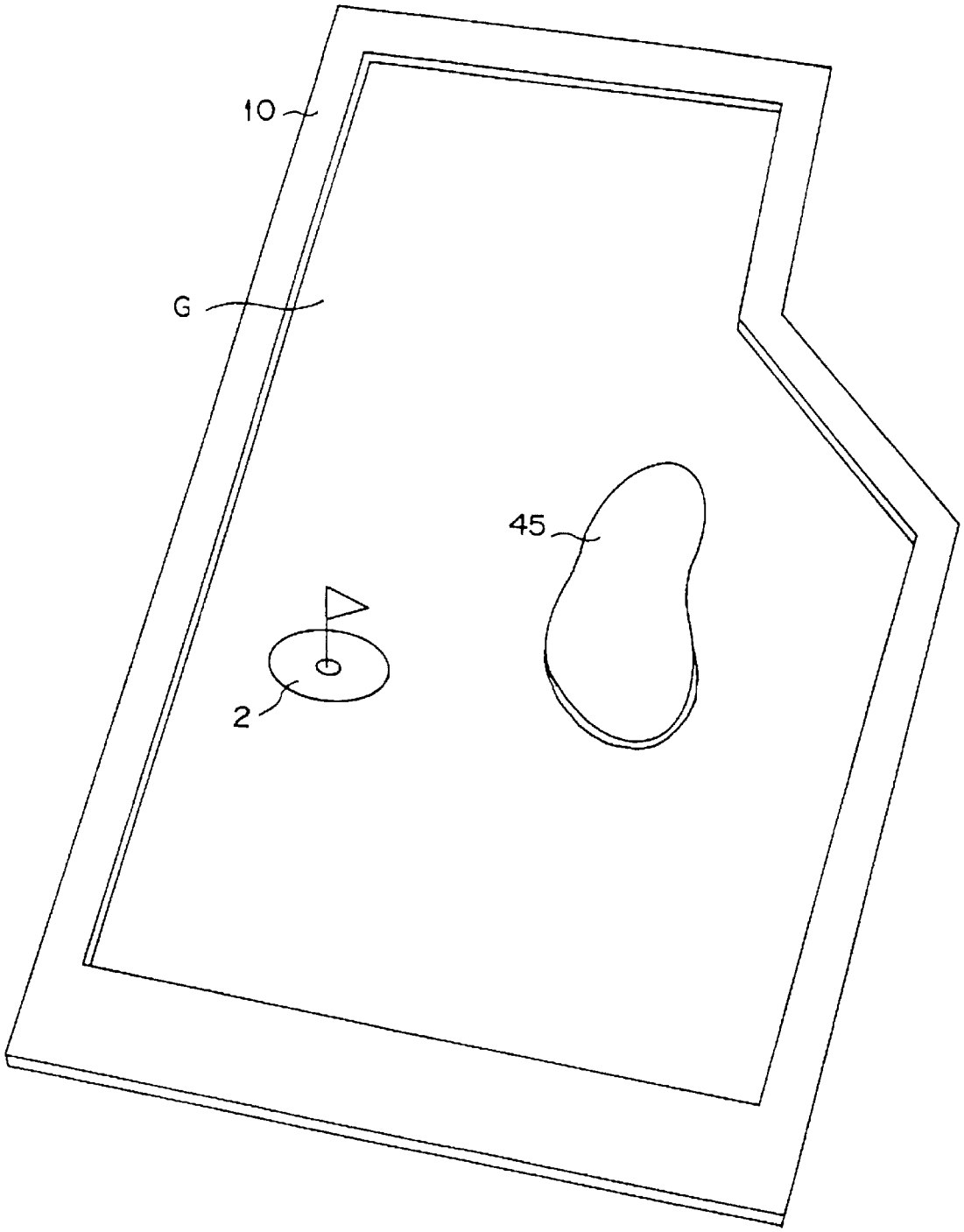
FIG. 15 is an outlined perspective view showing an example of a bunker or a dummy pond disposed in the green.

FIG. 15 is an outlined perspective view showing an example of a bunker or a dummy pond disposed on a green. In FIG. 15, the green G is constructed in the same manner as the green shown in FIGS. 2 and 3. An artificial turf belt 10 having the same cut portions as the cut portions 10*a* is disposed on the periphery of the green G. The green G is formed in an almost planar shape. A bunker or dummy pond 45 is disposed on the green G.

Figure 16:
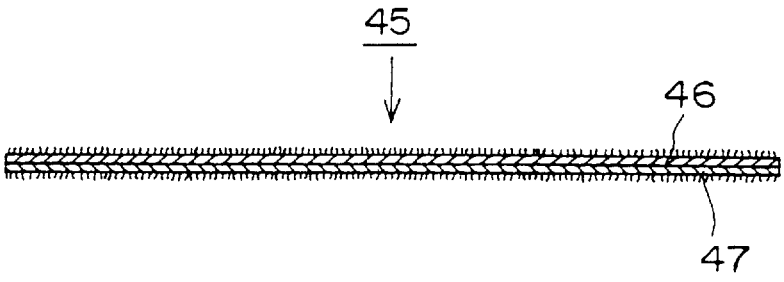
FIG. 16 is an outlined sectional view of a bunker or dummy pond 45.

FIG. 16 is an outlined sectional view showing the bunker or dummy pond 45. The bunker or dummy pond 45 has differently colored artificial turf 46 and 47 of the same material. The color of the artificial turf 46 is, for example, beige or gray. The color of the artificial turf 47 is, for example, blue. The non-turf surfaces of the base layer members of the artificial turfs 46 and 47 are adhered together with a rubber type adhesive agent, an epoxy type adhesive agent, or the like. In such a construction, by reversing the bunker or dummy pond 45, the concealed surface can be exposed. Thus, the appearance of the green can be varied. The artificial turf of the bunker or dummy pond 45 may be of a tuffed type, a looped type, or a combination thereof. When the materials of the artificial turf of the bunker or dummy pond 45 are the same, they will not warp or buckle even if the temperature varies. Even if the materials of the artificial turf are different, as long as their thermal expansion coefficients are the same, they can be used without fear of warping or buckling. However, generally speaking, since artificial turfs composed of the same material have the same thermal expansion coefficient, the adhesion of these turfs together is easier than when different types of turfs are adhered together. When the above-described bunker or dummy pond is actually fabricated by adhering two differently colored turfs of the same size together, bunkers or dummy ponds 45*a*, 45*b*, 45*c*, 45*d*, 45*e*, and 45*f* can be cut off economically.

The structural members necessary for forming the playground golf course according to the present invention have been described. However, it should be noted that the number of greens (holes) of the golf course can be 18, nine (as shown in FIG. 1), six, or three as desired. The provider of such a golf course can therefore rent or sell a set of prefabricated structural portions to meet customer requirements.

Figures 18A, 18B, 18C:
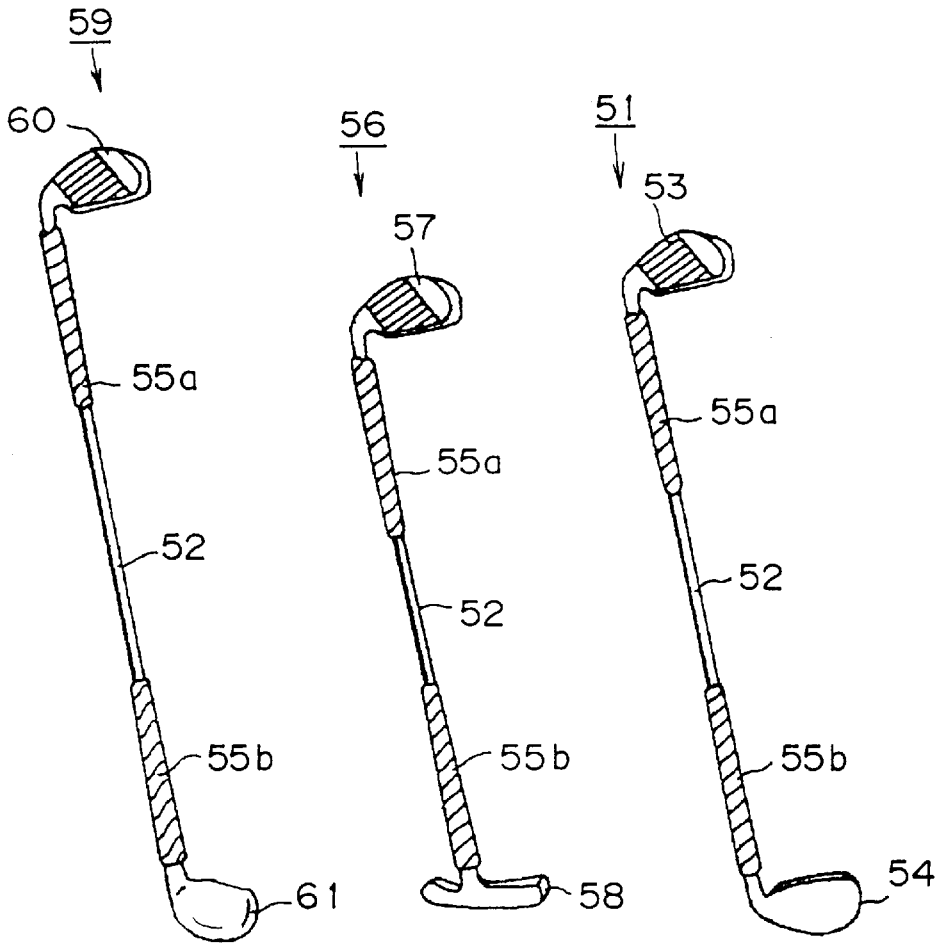
FIGS. 18A, 18B, and 18C are outlined perspective views of golf clubs designed for use with the proposed a playground golf course.

FIGS. 18A, 18B, and 18C are outlined perspective views showing golf clubs designed for use with the above-described playground golf course. FIG. 18A shows a golf club 51 having a shaft 52, a No. 6 iron club head 53 formed at one end thereof, and a No. 8 iron club head 54 formed at the other end thereof. In FIG. 18A, the club face of the club head 54 faces away from the viewer. Thus, in FIG. 18A, the rear side of the club face appears. Grips 55*a* and 55*b* are formed on both sides of the shaft 52. FIG. 18B shows a golf club 56 having a shaft 52, a pitching wedge club head 57 formed at one end thereof, and a putter club head 58 formed at the other end thereof. The other portions of the golf club 56 are the same as those of the golf club 51 shown in FIG. 18A. FIG. 18C shows a golf club 59 having a shaft 52, a No. 4 iron club head 60 formed at one end thereof, and a driver club head 61 formed at the other end thereof. In FIG. 18C, the club face of the club head 61 faces away from the viewer. The other portions of the golf club 59 are the same as those of the golf club 51 shown in FIG. 18A. The golf clubs shown in FIGS. 18A, 18B, and 18C have been designed for right-handed players. However, left-handed players, golf clubs with each of the above-described golf club heads are available. Of these golf clubs, the golf club 56 shown in FIG. 18B and the left-hander type golf club version thereof should be used for the above-described playground a golf course.

Figure 18D:
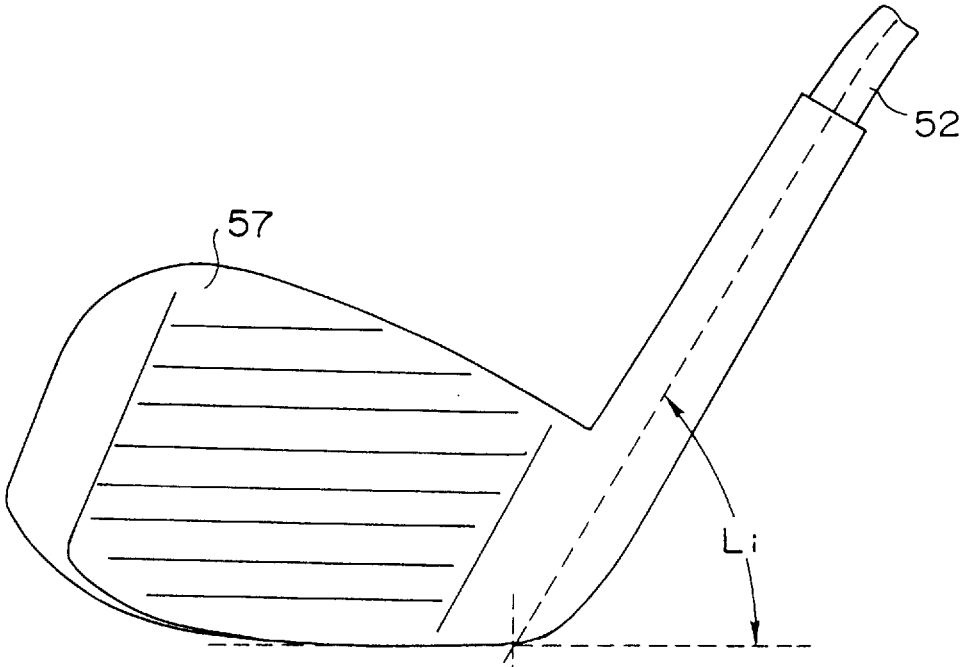
FIGS. 18D and 18E are outlined schematic diagrams for further explaining the golf club 56 shown in FIG. 18B.
Figure 18E:
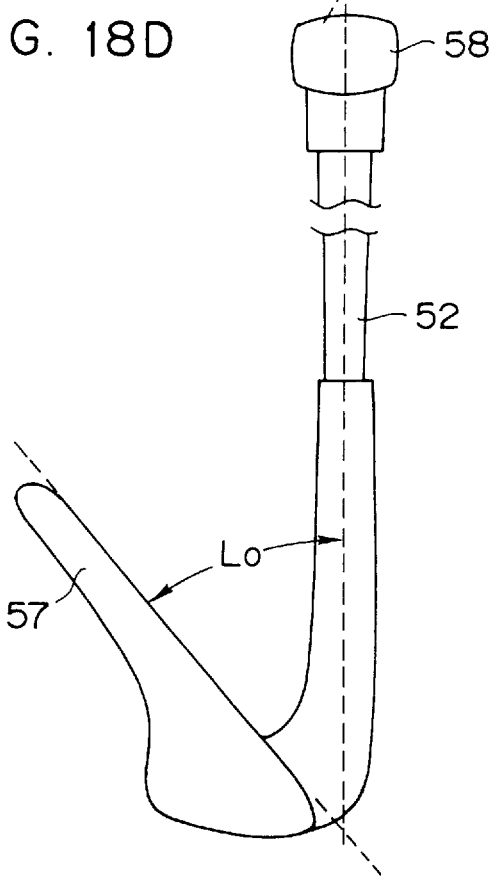
Figure 18F:
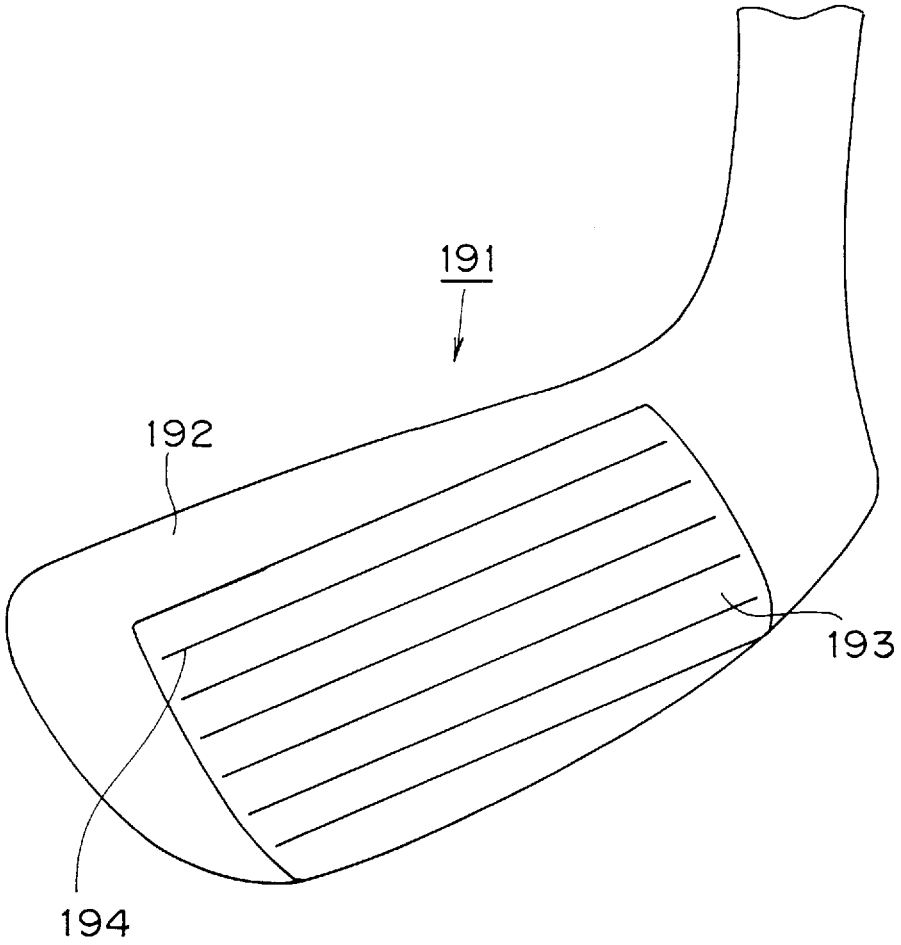
FIG. 18F is a general view showing the configuration of the head of an iron golf club.

FIG. 18F is a general view showing the configuration of a club head applicable to the golf clubs 51, 56, and 59 shown in FIGS. 18A, 18B, and 18C.

FIG. 18F shows the iron club head 191. The body 192 of the club head 191 is made of synthetic resin. If the entire club head 191 is made of synthetic resin, the center of the gravity becomes higher, or the resilience of the ball is reduced. Thus, a concave portion is designed in the face of the club head 191 in producing the body 192 so that the center of gravity can be lowered, the resilience of the golf ball can be maintained to match that of the metallic ball to give players an appropriate impact against the ball, and the club head itself can be reinforced. A brass, stainless steel or other metallic plate 193 of 1 mm through 3 mm in thickness and desirably 1.5 mm in thickness is fitted to the above described concave portion. The plate 193 is fixed to the body 192 using adhesives, screws, or pins. Several lines 194 are drawn as ornaments on the surface of the above described plate 193.

Figure 18G:
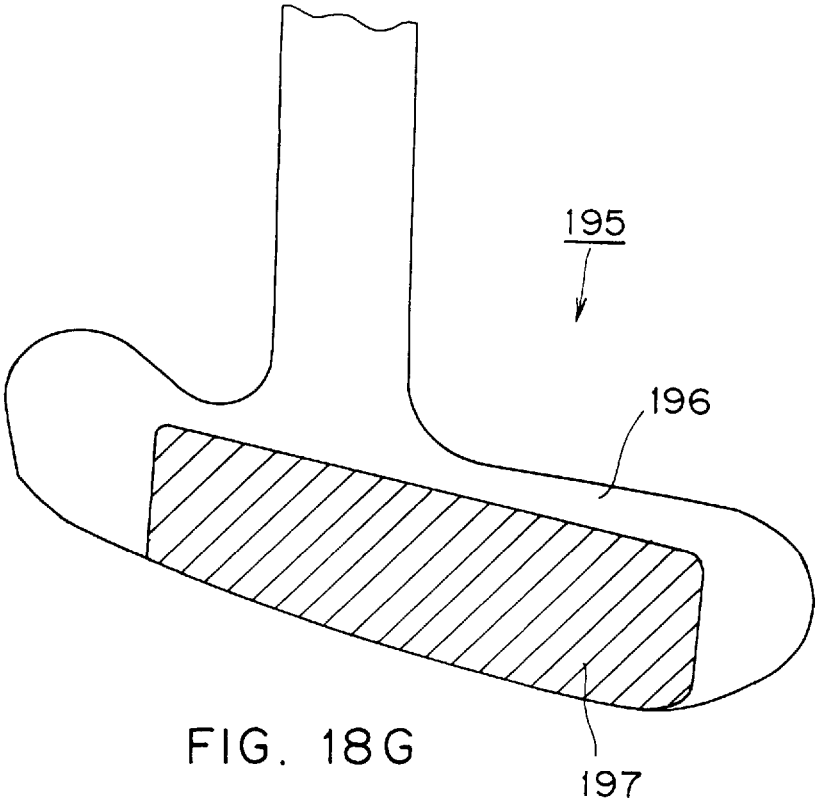
FIG. 18G is a general side view of the head of a putter as a golf club.
Figure 18H:
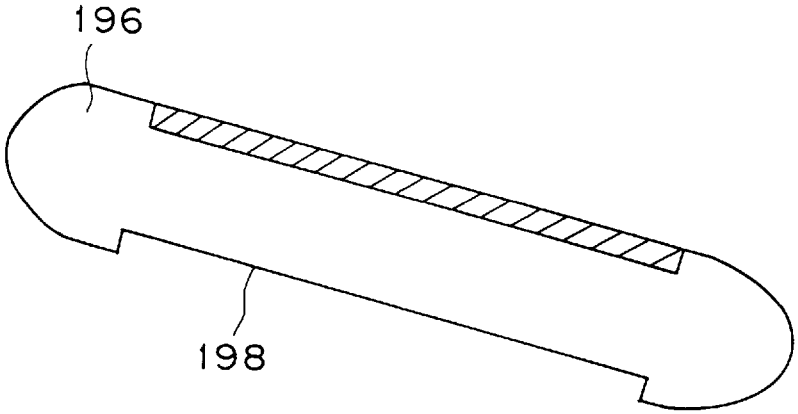
FIG. 18H is a general view of the bottom of the head of a putter.

FIG. 18G is a general side view of a putter. FIGS. 18H and 18G are general views showing the bottom of the club head shown in FIG. 18G. By referring to these figures, the body 196 of the club head 195 as well as the body 192 is formed by synthetic resin. A concave portion is formed in the face of the club head 195 to form the body 196, and is provided with the brass, stainless steel, or other metallic plate 197 of about 1 through 3 mm (desirably 1.5 mm) in thickness with adhesives, screws, or pins used as fixing agents for fixing the plate 197 to the body 196. For a left-handed player, the plate 197 should be fixed to the concave portion 198 to arrange the face opposite to the design shown in FIG. 18G. The club can be designed for both right- and left-handed players by applying the metallic plate to a corresponding concave portion.

FIGS. 18D and 18E are partially enlarged views showing the golf club 56 shown in FIG. 18B in more detail. In FIGS. 18D and 18E, the lie angle (Li) of the pitching wedge club head 57 (namely, the angle between the sole of the club head 57 and the mounting angle of the shaft) is around 60° C. (see FIG. 18D). In addition, the loft angle Lo of the club head 57 (namely, the inclination angle of the club head 57 to the club face) is around 45° viewed from the edge of the shorter horizontal portion of the putter club head 58 that extends from the shaft 52 to both sides (namely, in a direction of which the putter club head 58 is not viewed in a T-shape) to the shaft 52 (see FIG. 18E). Experimental results show that the golf club with the above-described lie angle and loft angle can be used very easily.

Figure 19B:
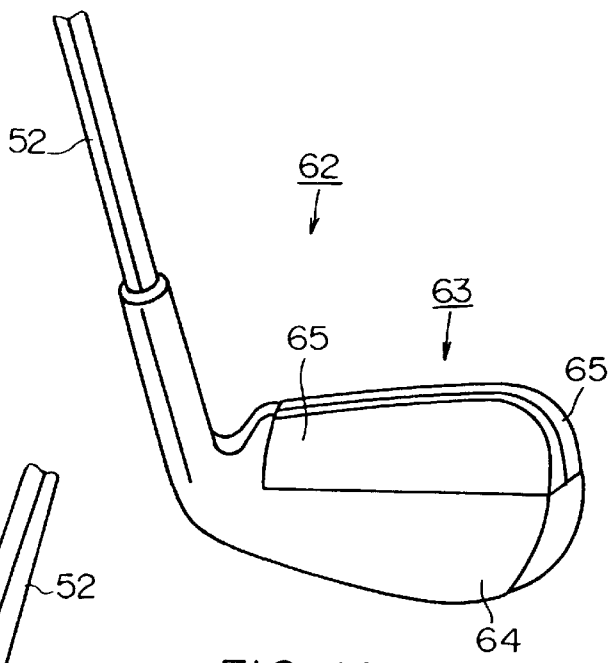
FIGS. 19A, 19B, and 19C are outlined perspective views showing other examples of golf clubs designed for use with the playground golf course.
Figure 19D:
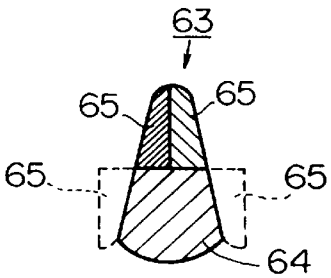
FIG. 19D is a sectional view taken along line X—X of FIG. 19A.
Figure 19A:
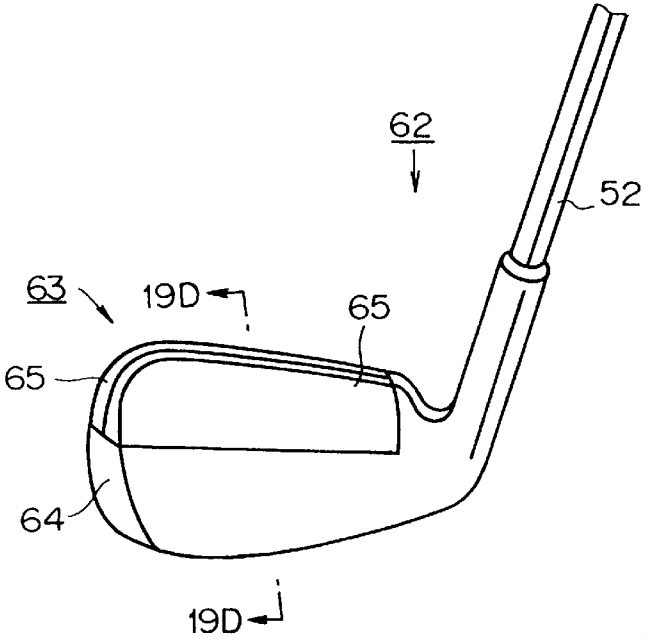
Figure 19C:
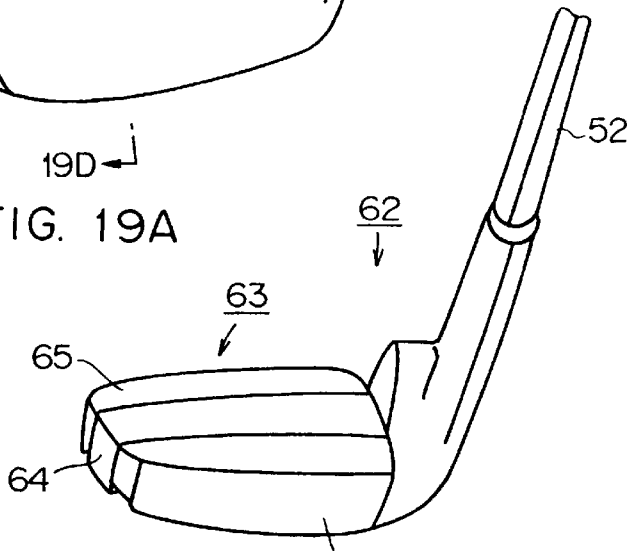

FIGS. 19A, 19B, and 19C are outlined perspective views showing other examples of golf clubs designed for use with the above-described playground golf course. FIG. 19D is a sectional view taken along line X—X of FIG. 19A. Referring to FIGS. 19A, 19B, and 19(C), a club head 63 is formed at one end of the shaft 52 of a golf club 62. The club head 63 has a base portion 64. Movable portions 65 are connected to the base portion 64 with hinges or the like. In FIGS. 19A, 19B, and 19C, the hinges are omitted. When the movable portions 65 are closed (see FIGS. 19A and 19B), the connecting surface of the side surfaces of the movable portions 65 and the side surface of the base portion 64 become a hitting surface and the golf club head functions as an iron club head. When the movable portions 65 are open (denoted by dotted lines in FIGS. 19C and 19D), the side surfaces of the movable portions 65 that are open become a hitting surface, and the golf club head functions as a putter club head. To securely open and close the movable portions 65, a ring, vinyl tape, packing tape, or the like may be wound around the movable portions 65. Alternatively, a rubber bag or a special securing pin may be used to hold the movable portions 65 in the desired position. The other end of the shaft 52 has a grip (not shown) as with a conventional golf club. However, two selected types of club head may be formed at both ends of the shaft 52. Moreover, grips may be formed on both sides of the shaft 52. In FIG. 19, the golf club 62 has two movable portions 65. However, the movable portions 65 may be integrally formed as one movable portion which may be bent to either of the two sides via a hinge.

Figure 20A:
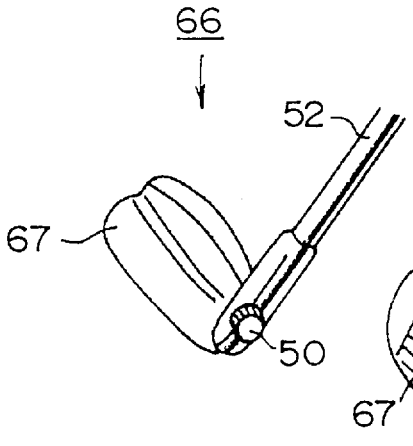
FIGS. 20A and 20B are outlined perspective views showing other examples of golf clubs designed for use with the playground golf course.
Figure 20B:
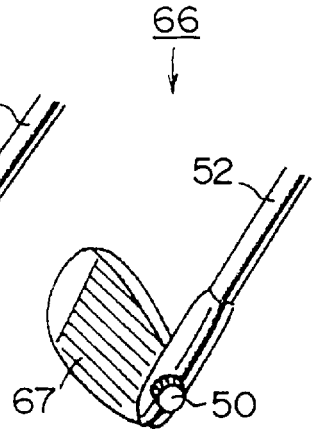

FIGS. 20A and 20B are outlined perspective views showing other examples of golf shafts designed for use in the above-described playground golf course. As shown in FIGS. 20A and 20B, a club head 67 is formed at one end of the shaft 52 of a golf club 66. A hitting surface that functions as a putter club head is formed on one surface of the club head 67 (see FIG. 20A). A hitting surface that functions as an iron club head is formed on the reverse surface of the club head 67 (see FIG. 20B). The club head 67 is secured to the shaft 52 by screwing a bolt into a screw hole in the vicinity of the lower portion of the shaft 52. A head portion 50 that functions as a stopper and a knob is formed at the end of the bolt. By turning the head portion 50 with fingers and loosening the club head 67, the hitting surface of the club head can be adjusted to obtain the optimum position of the club head 67 in relation to the shaft 52 and then, by screwing the bolt and securing the club head to the shaft 52, the golf club 66 can be used.

Figure 21A:
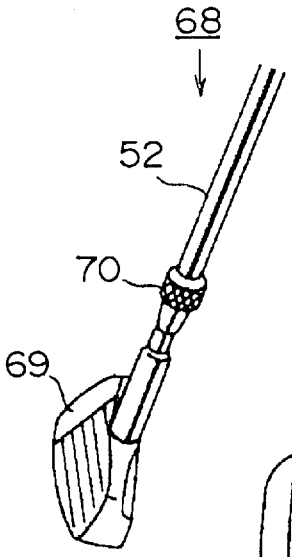
FIGS. 21A and 21B are outlined perspective views showing other examples of golf clubs designed for use with the playground golf course.
Figure 21B:
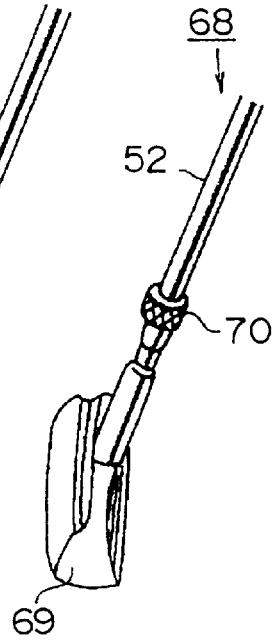

FIGS. 21A and 21B are outlined perspective views showing another example of a golf club designed for use with the above-described playground golf course. In FIGS. 21A and 21B, a club head 69 is formed at one end of a shaft 52 of a golf club 68. As with the golf club shown in FIG. 20, a hitting surface that functions as an iron club head is formed on one surface of the club head 69 (as shown in FIG. 21A). A hitting surface that functions as a putter club head is formed on the other surface (as shown in FIG. 21B). By screwing a partially protruding shaft member of the club head 69 into the shaft 52 and then screwing a tightening ring 70, the club head 69 can be secured. Conversely, by loosening the tightening ring 70, the club head 69 can be removed from the shaft 52. The tightening ring 70 has inner threads, while the shaft portion corresponding to the tightening ring 70 has outer threads. The shaft portion has slots extending from the threaded portion to the lower edge. The detachable construction of the club head 69 may be obtained by other means. For example, a threaded rod may be formed at part of the peripheral wall of the club head 69, and a threaded hole that fits to the screw rod may be formed at the end of the shaft 52. When the angle of the club head 69 needs to be adjusted, a lock nut may be disposed in the middle of the screw rod and tightened as necessary.

The club head shown in FIG. 19 may be used for the golf club shown in FIG. 18. Thus, one basic golf club may function as three to four types of golf clubs. On the other hand, by applying the club head shown in FIG. 20 or 21 for the golf club shown in FIG. 18, two of a variety of club heads may be attached to one shaft. Moreover, the shaft may be formed in an extendable shape as with an extendable fishing rod.

Since the above-described golf club functions as different types of clubs, the number of golf clubs necessary for one golf club set can be reduced. Thus, a golf club that is both portable and economically fabricated can be obtained. In addition, the golf club can be easily carried on the course. Moreover, the golf club is less likely to be misplaced or to trouble other players.

Figure 22:
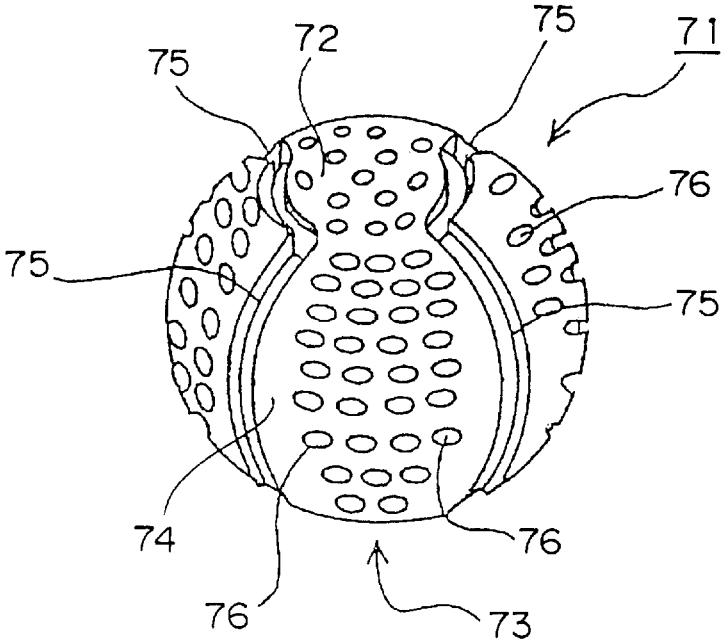
FIG. 22 is a perspective view showing an example of a golf ball designed for use with the playground golf course.

FIG. 22 is a perspective view showing an example of a golf ball designed for use with the above-described playground golf course.

In FIG. 22, a golf ball 71 is formed as a spherical member with a diameter of from 41.15 mm to 42.67 mm and a weight of from 23.5 g to 29.5 g. The material of the golf ball 71 is soft rubber, plastic, or polyurethane foam. In particular, when the golf ball 71 is composed of light polyurethane foam, it has a moderate flying distance (less than that of a conventional golf ball). With the golf ball 71, the player can experience a similar hitting feel to that of a conventional golf ball. In addition, the golf ball 71 is formed by adding a proper amount of foaming agent to the liquid polyurethane so that the final golf ball has a diameter from 41.15 mm to 42.67 mm and a weight from 23.5 g to 29.5 g and floats in water (the hemi-spherical portion is exposed to the air).

The golf ball 71 has a top portion 72 integral to a convex side portion 74, both being delineated by a groove 75 therearound. In addition, the golf ball 71 has a bottom portion of the same shape as the top portion 72 and the integral convex side portion 74. The groove 75 also surrounds these portions. In other words, the groove 75 separates the top portion 72 and the side spherical portion 74 adjacent thereto from the other portions similar thereto. Thus, when the golf ball is upended and rotated clockwise or counterclockwise by 90°, it shows the same state as depicted in FIG. 22. The depth of the concave groove 75 is from 0.3 mm to 0.5 mm.

Figure 23:
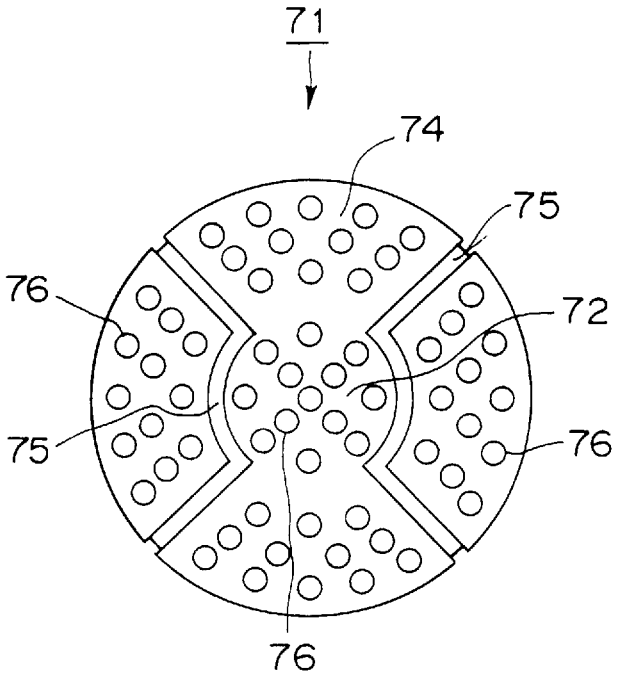
FIG. 23 is a plan view of a golf ball 71.

A proper number of dimples are formed on the top portion 72, the integral convex side portion 74 adjacent thereto, and the portions similar thereto. FIG. 23 is a plan view showing the golf ball 71. A fluorescent paint such as a luminous paint or a light storing paint may be coated on the groove 75 so that the golf ball can be easily found at night.

To form the golf ball 71, two paired hemispherical dies with convex portions corresponding to the groove 75 are locked together and a liquid plastic material containing a predetermined amount of foaming agent is injected therein. After a predetermined time elapses, the liquid plastic solidifies. By separating the paired die members, a spherical golf ball 71 is obtained. If desired, the emblem of a golf club or the like can be printed on it.

The above-described golf ball can have a very simple pattern although it can be distinguished from all directions. In addition, such a pattern can be formed with a deep groove. Due to the drag caused by the dimples and the groove, flight distance can be reduced. Moreover, the pattern of the golf ball hardly disappears. Furthermore, in addition to reducing the flight distance due to the use of buoyant material, the flying distance of the golf ball 71 can be properly designated.

The material of the golf ball 71 can be, as described above, soft rubber, plastics, or foam polyurethane. These materials can be replaced with biodegradable materials. For example, starch, alginic acid, or a mixture of these materials is made to foam, formed into a sphere, and finished as a golf ball after applying a grazing paint on the ball. A weight adjusting agent can be the starch, alginic acid, or the mixture of these materials with pine oil added thereto. Thus, if a golf ball is formed by such biodegradable materials, it is completely decomposed (decomposition starts from one week or so) after it gets lost in the sea, river, lake, pond, or other difficult places in the playground (a fine hole is made from the surface into the center if necessary), thereby preventing the environment from being polluted by lost balls.

Figure 24:
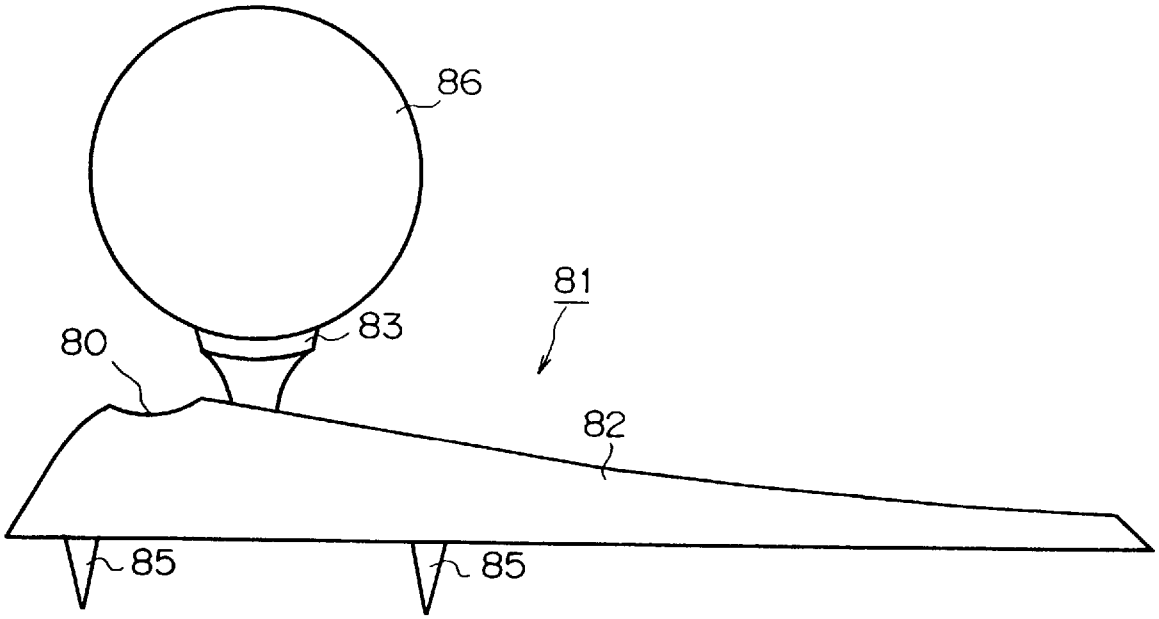
FIG. 24 is a schematic diagram showing an example of the construction of a golf tee designed for use with the playground golf course.

FIG. 24 is a schematic diagram showing an example of the construction of a golf tee designed for use with the above-described playground golf course.

In FIG. 24, a golf tee 81 has a tee base 82 and a tee main body 83. The tee base 82 is formed in an elongated elliptic shape of which the width of the tail portion (on the right side of the drawing) is slightly narrower than the width of a head portion (on the left side of the drawing). The tee base 82 is around 15 cm long and around 4.5 cm wide. The periphery of the rear surface of the tee base 82 has a hem of around 5 mm. The inside of the hem is formed as a shallow concave portion. The top surface of the tee base 82 gradually rises from the tail portion to the head portion. The tee main body 83 is secured to the tee base 82 in the vicinity of the center portion that is the highest position on the tail. Three protruding legs 85 are formed around a portion corresponding to the tee main body 83 of the rear surface. When the tee base 82 is placed on a mounting surface such as a teeing ground or a rough, the legs 85 stick into the mounting surface and thereby fix the tee base 82 thereon. When a concave region 80 with a curved surface that almost matches the curvature of a golf ball 86 (that will be described later) is formed in the vicinity of the top of the head of the tee base 82, the golf ball 86 can be directly placed in the concave region 80 and can be driven with a golf club without need to use the tee main body 83.

Figure 25B:
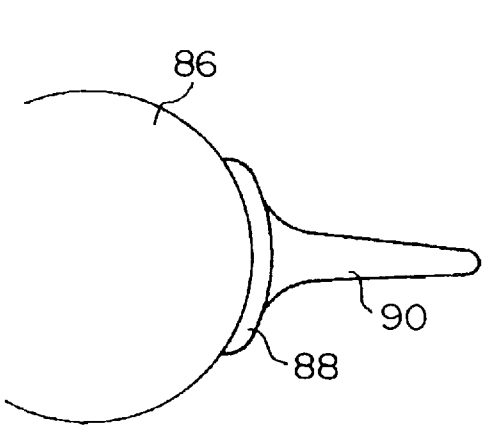
FIGS. 25A, 25B, and 25C are schematic diagrams showing an example of another tee main body designed for use with the playground golf course.
Figure 25A:
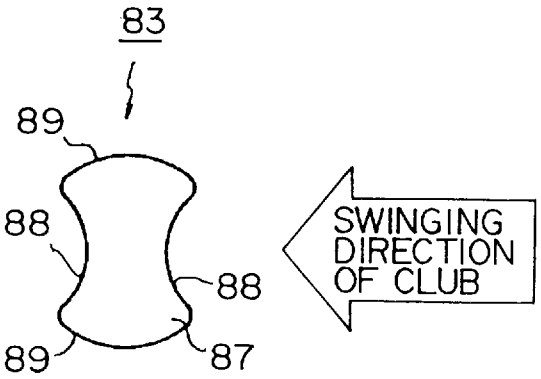
Figure 25C:
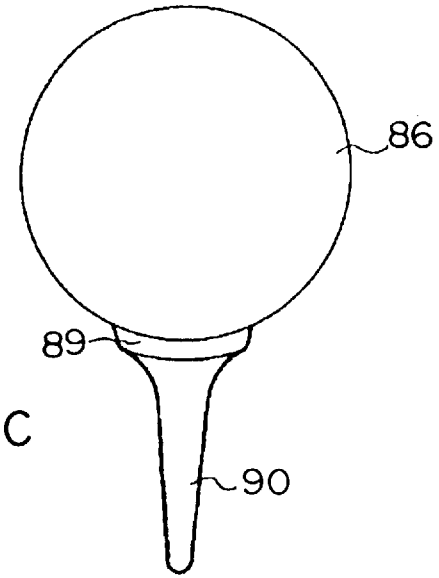

FIGS. 25A, 25B, and 25C are schematic diagrams showing the construction of the tee main body. Referring to these drawings, the tee main body 83 has a holding portion 87 that holds the golf ball 86 (including the golf balls shown in FIGS. 22 and 23). The holding portion 87 has two concave arc sides 88 which are at right angles to the direction of golf club travel and thus has minimum width. Two convex arc sides 89 are formed adjacent and perpendicular to the two concave arc sides 88 which are at right angles to the direction of golf club travel and thus has minimum width. Two convex arc sides 89 are formed adjacent and perpendicular to the two concave arc sides 88 so as to securely hold the golf ball 86. The surface surrounded by two concave arc sides 88 and the two convex arc sides 89 is formed as a concave surface corresponding to the curvature of the golf ball 86.

A cone-shaped leg 90 is formed below the holding portion 87. Nearly half of the length of the leg 90 is press-fit or adhered to a hole formed in the tee base 82. It should be noted that the tee base 82 and the tee main body 83 may be integrally composed of a plastic or a metal, and not be formed separately. In addition, the tee main body 83 may be formed in such a manner as to be easily detached from the tee base 82. When the tee base 82 is placed on an inclined surface, another tee main body that is formed corresponding to the inclination may be used (so that the holding portion becomes horizontal when the leg portion is inclined). Moreover, when the tee main body 83 is used, it may be stuck in the ground.

Figure 26B:
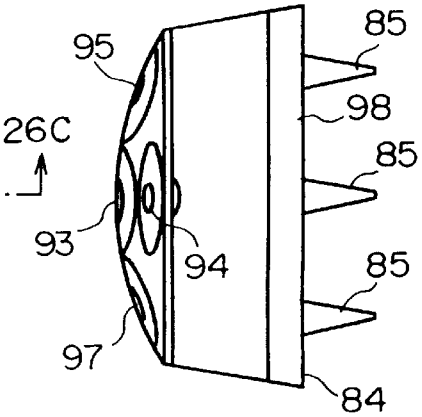
FIGS. 26A, 26B, and 26C are schematic diagrams showing the construction of another example of a golf tee designed for use with the playground golf course.
Figure 26A:
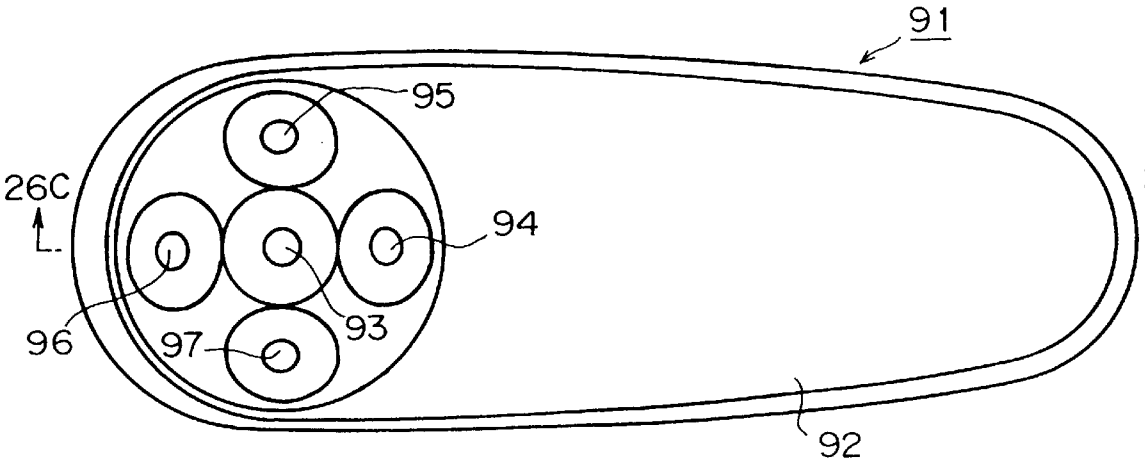
Figure 26C:
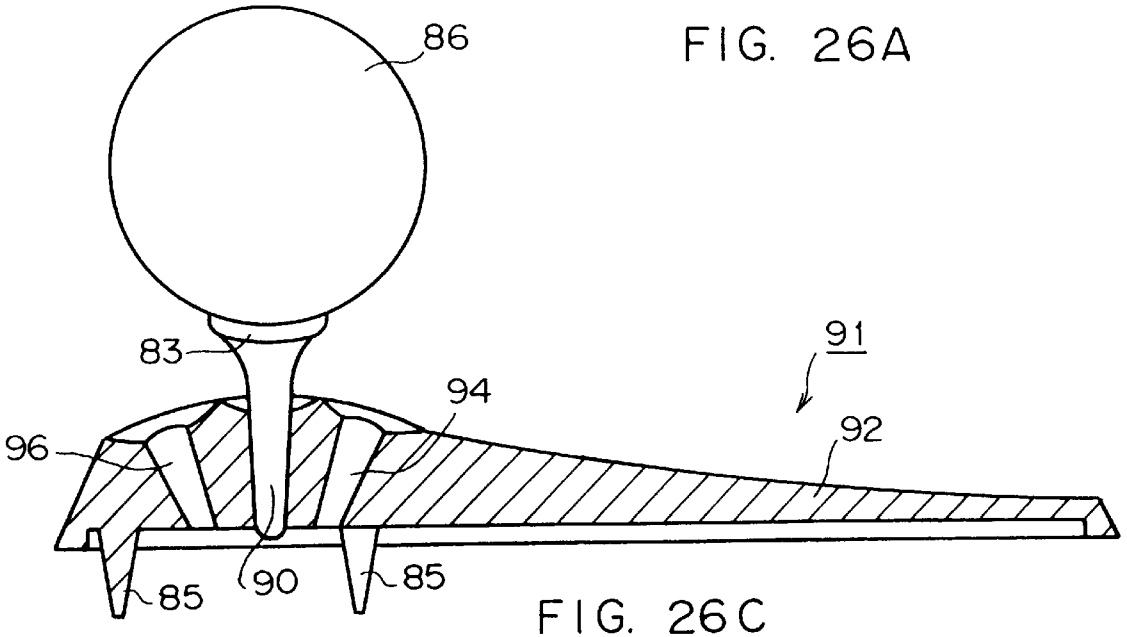

FIGS. 26A, 26B, and 26C are schematic diagrams showing another example of a golf tee designed for use with the above-described playground golf course. Referring to FIGS. 26A, 26B, and 26C, a golf tee 91 has a tee base 92 and a tee main body 83. As with the above-described tee base 82, a hem with a width of around 2.5 cm is formed around the peripheral of the rear surface of the tee base 92. A shallow concave portion 98 is formed inside the hem. A hole 93 is formed in the head portion of the front surface of the tee base 92 so as to hold the leg 90 of the tee main body 83 nearly vertical when the tee base 92 is placed on a flat surface. Four holes 94, 95, 96, and 97 that hold the tee main body 83 at an angle of around 20° from the vertical are formed around the hole 92 at intervals of 90° on the horizontal plane. Therefore, even if the tee base 92 is placed on an inclined surface, a proper hole into which the tee main body 83 is inserted can be selected using holes 94, 95, 96, and 97 so that the leg is placed close to the vertical. The tee base 82, the tee base 92, and the tee main body 83 can be composed of wood, plastic, metal, or the like. When these portions are composed of wood, the grain of the wood can be shown or it can painted over. When they are composed of plastic, they can be distinguished with different color pigments. Although the peripheral portions of the holes 93, 94, 95, 96, and 97 are formed as shallow concave surfaces, they are not necessarily formed as the shallow concave surfaces but may simply be formed as flat surfaces. Moreover, in the embodiment, the four holes 94, 95, 96, and 97, which hold the tee main body 83 at an inclination angle of around 20° from the vertical, are formed on the horizontal plane at intervals of 90°, and the inclination angle is not limited to 20°. Instead, the inclination angle of the holes 94, 95, 96, and 97 may be varied. The number of the holes 94, 95, 96, and 97 may decrease three or less. Furthermore, as a modification of the embodiment, a criss-crossed groove instead of the holes 93, 94, 95, and 96 may be formed so as to insert the leg portion 90 of the tee main body 83 into a part of the groove.

Figure 26D:
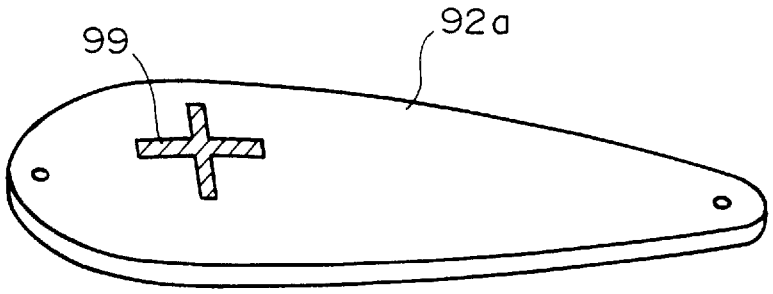
FIG. 26D is a general oblique view showing an example of the base of a tee having cross-shaped grooves.
Figure 26E:
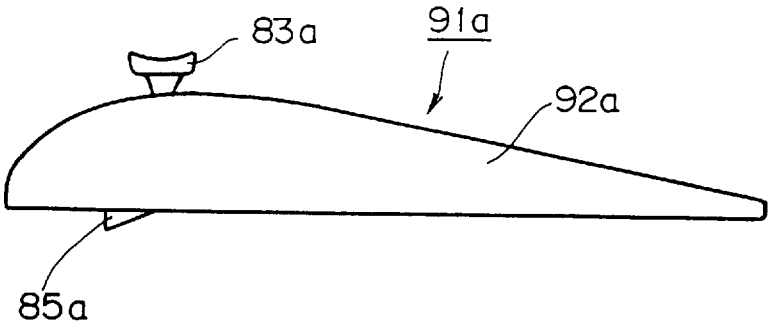
FIG. 26E is a side view of a tee when a tee body is added to a tee base.

FIG. 26D is a general oblique view showing an example of a tee base provided with criss-cross grooves. FIG. 26E is a side view of a golf tee viewed from the side of the tee base (shown in FIG. 26D) provided with the tee body. The tee base 92*a* is made of a resilient material such as soft plastics, rubber, etc. The criss-cross grooves 99 are made at one end of the tee base 92*a* to hold the leg of the tee body 83*a*. The material of the tee body 83*a* as well as the material of the tee base 92*a* is made of a resilient material to give a good bouncing. Two projecting legs 85*a* are formed with a clearance between them near the criss-cross grooves 99 on the reverse side of the tee base 92*a*. When the two projecting legs 85*a* are embedded in the artificial turf and the legs of the tee body are inserted to the criss-cross grooves 99, the golf tee 91*a* becomes applicable. Forming a concave portion near the cross point of the criss-cross portion 99 allows the tee base 92*a* to put a golf ball on (without the tee body 83*a*) and to also function as a golf tee 91*a*.

Figure 27B:
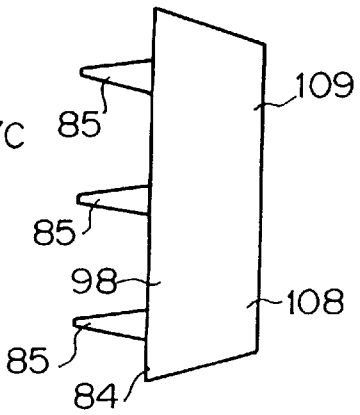
FIGS. 27A, 27B, and 27C are schematic diagrams showing a further example of the construction of a golf tee designed for use with the playground golf course.
Figure 27A:
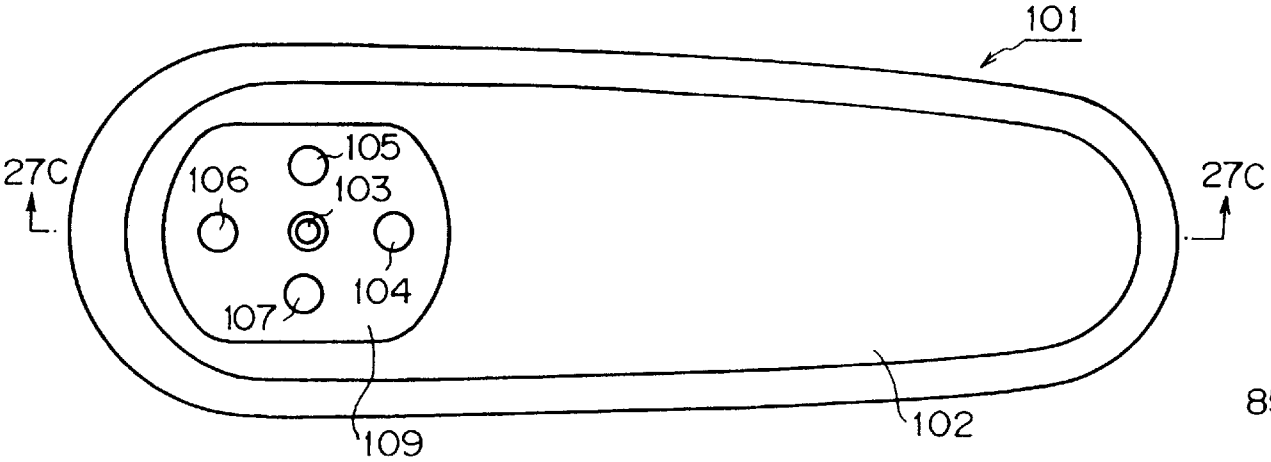
Figure 27C:
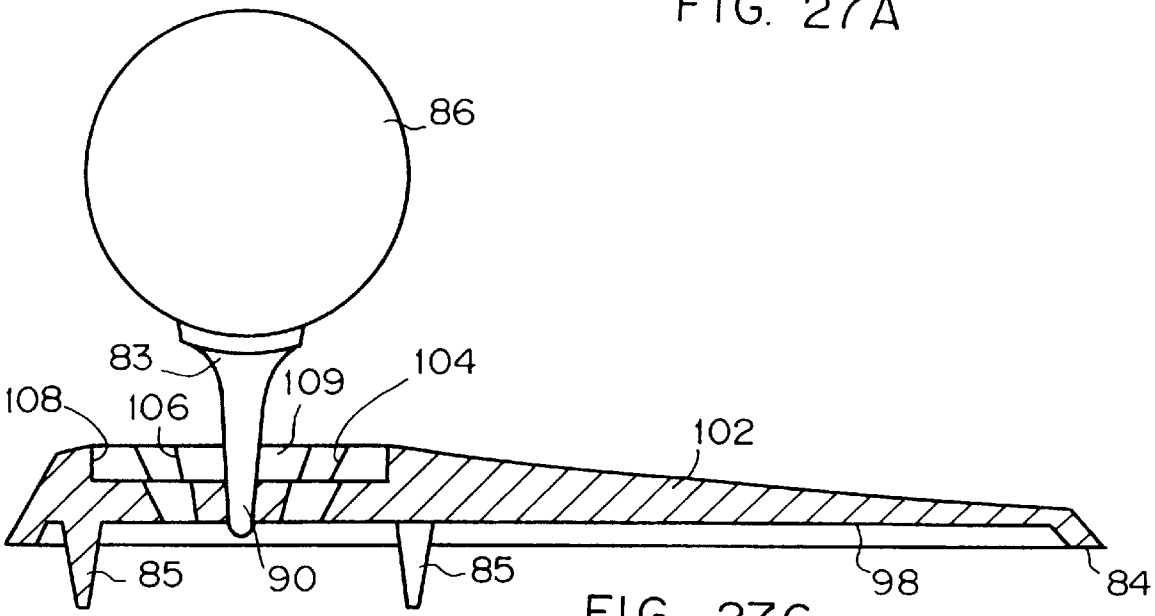

FIGS. 27A, 27B, and 27C are schematic diagrams showing another example of a golf tee designed for use with the above-described playground golf course. Referring to FIGS. 27A, 27B, and 27C, a golf tee 101 has a tee base 102 and a tee main body 83. The rear surface of the tee base 102 has the same construction as the tee base 92. A concave portion 108 is formed at a head of the front surface of the tee base 102. A leg holding plate 109 that has a hole for holding the leg 90 of the tee main body 83 is embedded in the concave portion 108. In other words, the leg holding plate 109 is detachable from the concave portion 108. The leg holding plate 109 is composed of for example, wood, plastic, steel, stainless steel, aluminum, brass, or other metal. A hole 103 that holds the leg portion 90 of the tee main body 83 nearly vertical is formed on the leg holding plate 109 when the tee base 102 is placed on a flat surface. Four holes 104, 105, 106, and 107 that hold the tee main body 83 with an inclination angle of around 20° to the vertical are formed around the hole 103 at intervals of around 90° in the horizontal plane. A variety of leg holding plates may be provided so that the tee main body 83 can be placed with an inclination angle of around 15° or 25° from the vertical. If necessary, one of these plates may be selected and substituted for the above-described leg holding plate 109. When a hole with a diameter that is larger than that of the holes 104, 105, 106, and 107 is formed on the concave portion 108 below these holes, even if any leg holding plate is embedded, the leg of the tee main body 83 is not affected by the peripheral wall of the hole. Instead of the tee main bodies 83 shown in FIGS. 26 and 27, another tee main body with a holding portion 87 inclined to the leg 90 corresponding to the inclination angle may be used. In this embodiment, the four holes 104, 105, 106, and 107, which hold the tee main body 83 at an inclination angle of around 20° from the vertical, are formed at intervals of around 90° on the horizontal surface. However, the inclination angle of the holes is not limited to 20° and the inclination angle may be varied. The number of the holes may be three or less.

Two concave arc sides 88 are formed on the holding portion 87 of the tee main body so that the width of the portion which is traversed by the head of a golf club is minimized. Thus, the head of a club can be prevented from knocking over the golf tee. In addition, since the two sides that are adjacent to the concave arc sides 88 are formed as convex arc sides 89, the area of the holding portion 87 that contacts a golf ball becomes large. As a result, the golf ball can be held securely. When the golf tee 83 is attached to the tee base 82, the golf tee 81 can be used since the tee base 82 is placed on a mounting surface. Thus, the turf can be protected from damage. If the tee main body 83 is damaged, when the tee base 92 has a plurality of holes, it can be substituted with another good one. When the place from which the player hits a golf ball is inclined, the tee main body 83 can be inserted thereinto by selecting a hole which makes the tee main body vertical. When the concave portion 108 is formed on the tee base 101 and the leg portion holding plate 109 that has a plurality of holes 103, 104, 105, 106, and 107 for holding the leg portion 90 of the tee main body is formed so as to embed in the concave portion 108, the leg holding plate 109 can be substituted with other one. The leg holding plate 109 is mounted to the concave portion 108 so as to correspond to the inclination angle of the mounting surface. The tee main body 83 is mounted on the leg holding plate 109. Thus, the player can hit golf balls easily.

When the above-described tee base is used, the golf ball can be held securely. In addition, when the player hits the golf ball, the portion that holds the golf ball does not affect the player's performance. Moreover, since the tee base is not affected by ground conditions, it can be placed anywhere.

Figure 28B:
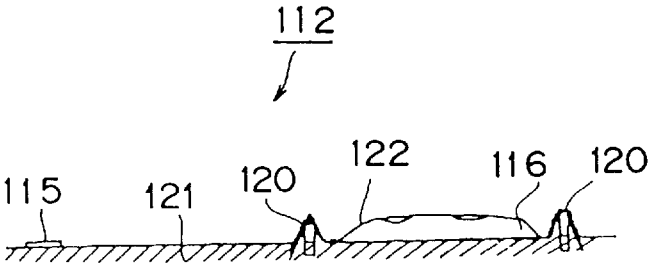
FIG. 28B is a side view of a golf playground shown in FIG. 28A.
Figure 28C:
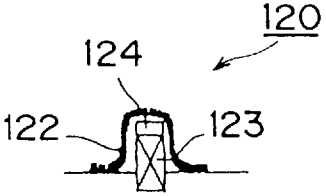
FIG. 28C is a general sectional view showing the structure of a fence.
Figure 28A:
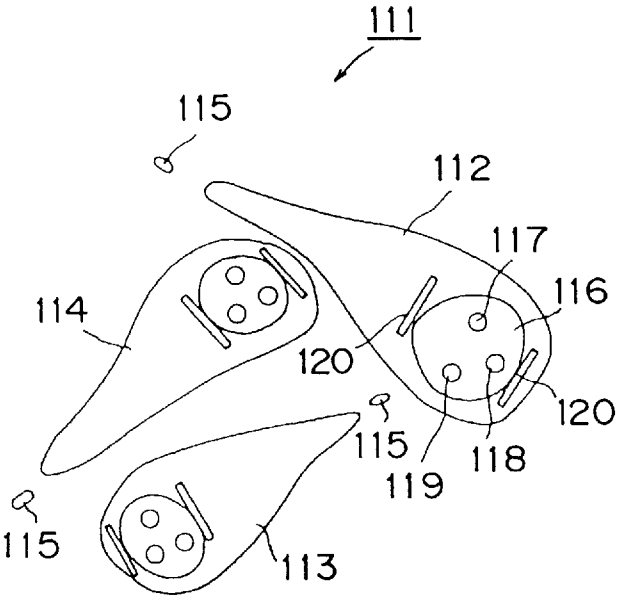
FIG. 28A is a bird's-eye view as a plan view of another golf playground.

FIG. 28A is a plan view of another golf playground to which the green shown in FIGS. 2, 3A, and 3B.

In FIG. 28A, a golf playground 111 is composed of, for example, 3 courses (112, 113, and 114) containing 9 holes. These courses 112, 113, and 114 are formed in about the same size. Described below is course 112 as representative.

First, the reference number of shots is set to 3 (par). Correspondingly, the distance between the tee ground 115 and the green 116 is set to a predetermined distance, for example, 30 m. Three hole cups are provided in the green 116. The OK zones 117, 118, and 119 are concentric circles. This is to terminate the game on the hole when the ball stops in the OK zones 117, 118, and 119 by adding 1 to the current score without completing the game by the final shot. When the OK zones 117, 118, and 119 are provided on one green 116, three holes can be included in one course 112, and three courses form a 9-hole golf playground. That is, three courses make up a half-round golf playground, requiring an area of about 9,900 $m^2$ only.

There are fences 120, 120 around the green 116. The fences 120, 120 approximately make a right angle with the line connecting the teeing ground 115 with the center of the green 116. The fence 120 is described by referring to FIGS. 28B and 28C.

FIG. 28B is a side view of the course 112. FIG. 28C is a general side sectional view showing the structure of the fence. In FIGS. 28B and 28C, the hole 112 is positioned in the teeing ground that is designed on the ground covered with artificial turf. A fairway 121 is the levelled ground, and a green 116 is arranged as shown in FIGS. 2, 3A, and 3B.

The fence 120 is, for example, formed by concrete blocks. If required, they are piled in 2 or 3 layers. A part of concrete blocks 123 in the first layer are fixed in the ground as shown in FIG. 28C. The height of the fence 120 is set to 10 cm through 30 cm, and the top surface of the concrete block at the top layer is covered with a foam material 124 functioning as cushion using an adhesive agent. The foam material 124 is furthermore covered with the artificial turf 122, thus completing the entire green 116 including the fence 120. The foam material 124 prevents the artificial turf 122 from directly touching the concrete blocks 123, and functions as cushion to prevent the artificial turf 122 from deteriorating through friction.

When starting a game in the golf playground designed with the fence 120, the distance between the teeing ground 115 and the green 116 is much shorter in the golf playground 111 than in a normal golf playground. Therefore, the number of clubs are limited to two, for example, a pitching wedge and a putter. If the first shot from the teeing ground reaches the green 116, a normal game can be performed without any problem. However, if the ball is not in the green 116 or if the ball is hit against the fence 120, then the ball bounds back. At this time, 1 is added to the current score, and the player proceeds to a predetermined approach zone to resume the game from the third shot for the green 116. The golf playground according to the present invention provides elaborately designed golf courses requiring correct shooting technic although they are rather short courses. Modifying the fence 120 allows the technical shooting level to be adjusted.

Figure 29A:
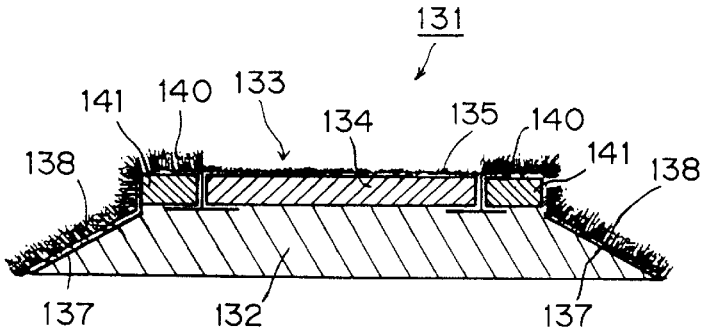
FIG. 29A is a general view of a teeing green.

FIG. 29A is a general sectional view of the teeing ground recommendable and applicable in the golf playground shown in FIGS. 1 and 28A. In FIG. 29A, a teeing ground 131 is designed such that a ground 132 is formed by the banking to make a mound. A surrounding portion 140 is formed for the teeing ground 131 on the ground 132. An artificial turf 137 is applied to a slope portion 138 from the surrounding portion 140 to a flat surrounding ground. The surrounding portion 140 comprises foam polyethylene, foam polyurethane, and other foam synthetic resin plates 141 of appropriate size. The surrounding portion 140 is formed as a ring of 15 cm–30 cm in width by sequentially coupling the foam synthetic resin plates 141. Then, the artificial turf 137 connected to the foam synthetic resin plate 141 is fixed to the foam synthetic resin plate 141 using nails and two-legged pins at necessary points to the foam synthetic resin plate 141 in a way that the end of the artificial turf 137 is caught by the ground 132 and the foam synthetic resin plate 141.

A mat member 133 is formed at a portion surrounded by the surrounding portion 140. The mat member 133 is provided with a buffering member 134 formed by foam polyethylene, foam polyurethane, and other foam synthetic resin plates. The buffering member 134 is covered with a artificial turf 135. The artificial turf 135 is fixed to the buffering member 134 using nails and two-legged pins at necessary points to the artificial turf 135 in a way that the end of the artificial turf 135 is caught by the ground 132 and the buffering member 134. If required, the artificial turf 135 and buffering member 134 can be fixed using rubber paste type adhesive agents.

The thickness of the artificial turf 137 is 40 mm–60 mm while the thickness of the artificial turf 135 is 5 mm–10 mm, that is, the artificial turf 135 is thinner than the artificial turf 137. With the configuration, the golf tee is not hidden in the artificial turf 135 when placed on it. The artificial turf 135 keeps its thickness and allows the mat member 133 and its surrounding area to be easily distinguished from each other.

Figure 29B:
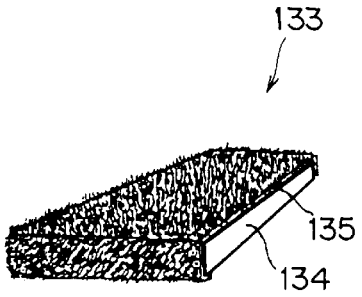
FIG. 29B is a general oblique view of the filler of a teeing ground covered with artificial turf.

The thickness of the foam synthetic resin plate for the buffering member 134 is formed to be about 15 mm–20mm. One or a required number of sheets of foam synthetic resin plates are layered according to the size of the teeing ground 131. Excess portions of the sheets are cut to form the buffering member 134. The artificial turf 135 is preliminarily added to the buffering member 134 as shown in FIG. 29B to form the mat member 133.

Figure 29C:
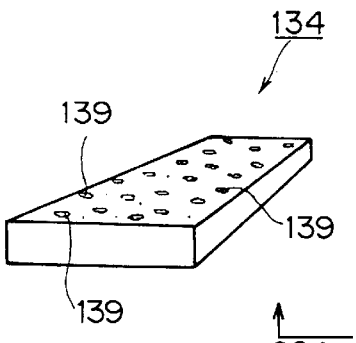
FIG. 29C is a general oblique view of a filler forming a teeing ground.

The buffering member 134 can be designed to have the permeability by providing a number of perforations 139 in the thickness direction as shown in FIG. 29C. If the perforations 139 is formed to have the diameter smaller than that of the golf tee not shown in FIG. 29C, then the golf tee can be stably set even if the leg of the golf tee is inserted to the perforation 139. The perforations 139 quickly pass the rain falling on the teeing ground 131 into the ground, thereby solving the problem that the rain water on the teeing ground 131 disturbs the players.

Figure 29D:
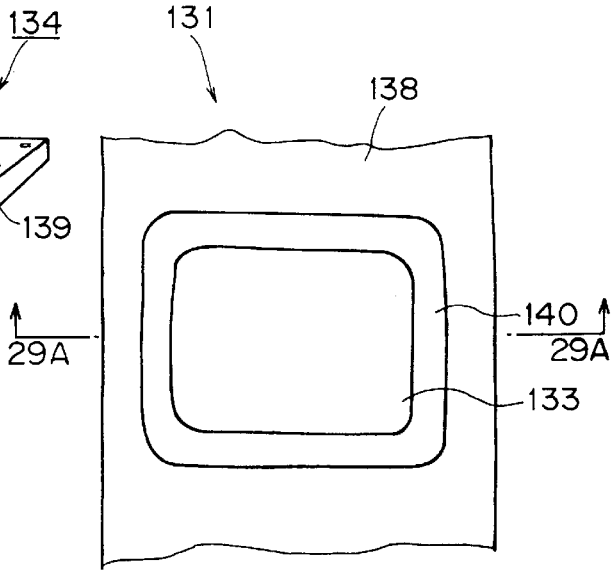
FIG. 29D is a general plan view of a teeing ground.

With the above described configuration, the teeing ground is produced as shown in FIG. 29D.

On the teeing ground 131 with the above described configuration, the player first sets the golf tee on the teeing ground 131 to start the game. At this time, the leg of the golf tee penetrates the artificial turf 135 and reaches the buffering member 134. Since the leg of the golf tee is surrounded by the buffering member 134, the golf tee is stably set on the teeing ground 131 and is easily pulled off the buffering member 134.

The hole made in the buffering member 134 by pulling the golf tee off the buffering member 134 can be restored to the original state through the resiliency of the buffering member 134. Therefore, the golf tee can be set by the grasp of the resiliency of the buffering member 134.

That is, the golf tee can be stably set at any position and at any time on the teeing ground 131.

The teeing ground 131 can be maintained and repaired by replacing only the buffering member 134 or the artificial turf 135 because the configuration of the teeing ground 131 is very simple. Therefore, it is costly.

The form of the teeing ground 131 is not limited to a rectangle, but can be any other forms.

Figure 30:
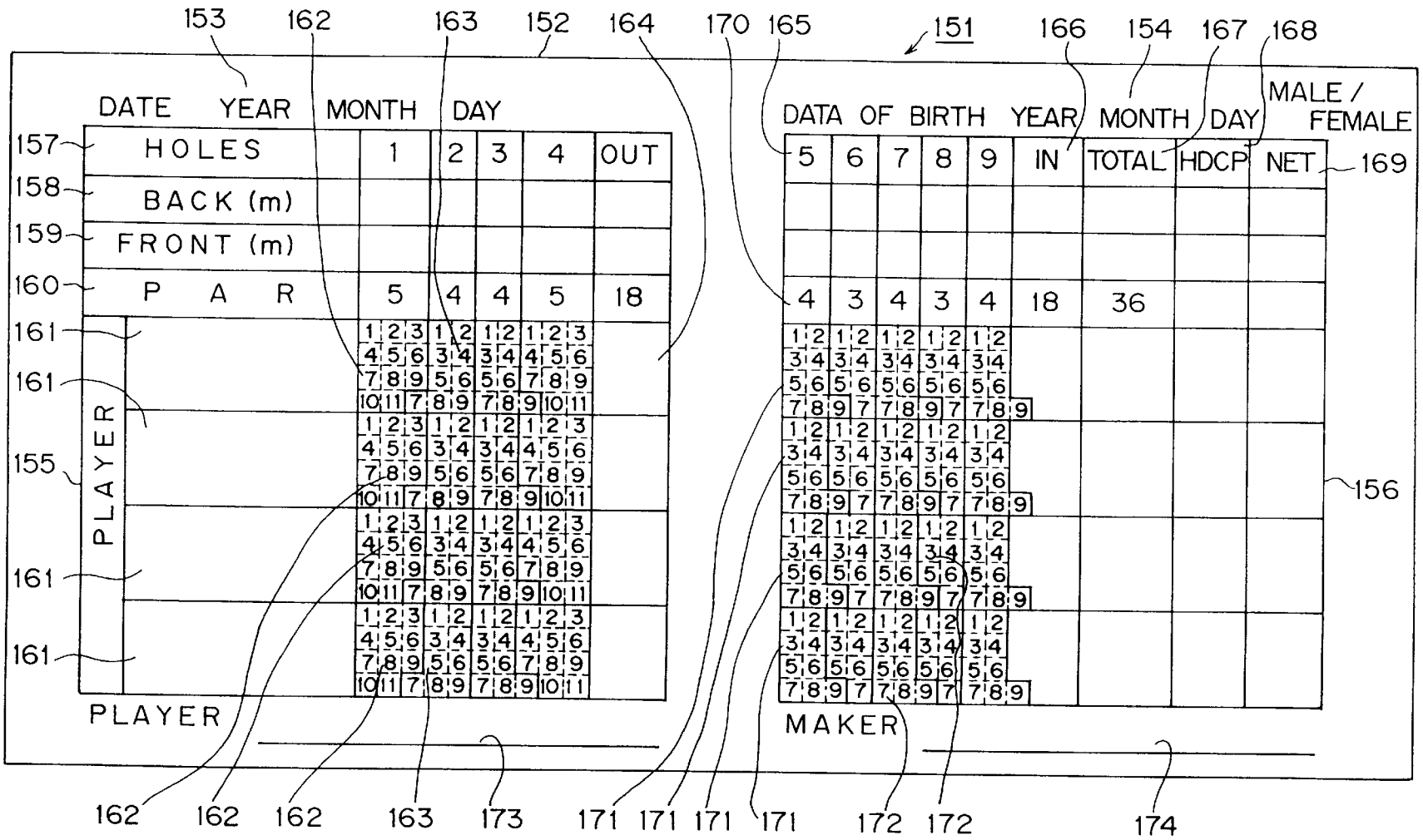
FIG. 30 is a plan view of an example of a golf score card.

FIG. 30 is a plan view showing an example of a golf score card applicable in a golf playground shown in FIGS. 1 and 28A.

In FIG. 30, the score card 151 is a paper or plastic sheet 152 provided with rule lines drawn to contain necessary items. For example, according to the score card 151, the rectangular sheet 152 of 14 cm in length and 24 cm in width stores the names of the players in the vertical direction and their scores in the horizontal direction. On the sheet 152, the left top column stores the date of the game 153, and the right top column stores the birthday and gender 154.

The sheet 152 is divided by rule lines into a right segment 155 and a left segment 156. For example, in the left segment, the columns store the scores for four holes from left to right. The top column in the left segment 155 displays the numbers of the holes 157, and the lower columns 158 and 159 respectively store the distances from the green to the back teeing ground and front teeing ground. The lower columns 160 indicate the numbers of reference strokes for respective holes. The further lower columns 162 store the numbers of respective players' strokes.

In the player's stroke column, each player does not write an actual number but marks with a circle for the corresponding number. For example, listed are the numbers each of which is obtained by doubling the reference number of strokes and adding 1 to the product. When there are too many numbers required to contain in the stroke number columns 162, then the adjacent stroke number columns 162 can be used additionally. Thus, the segmented stroke number columns 162 display a plurality of sets of numbers 163 based on the reference numbers of strokes.

That is, for example, if the reference number of strokes is 5, the stroke number columns 162 displays 11 sets of numbers 163 from 1 to 11. If the reference number of strokes is 4, the stroke number columns 162 displays 9 sets of numbers 163 from 1 to 9. At this time, if the adjacent columns stored the same reference number of strokes, the display space may be insufficient for the stroke number columns 162. Therefore, the reference stroke number columns having unused space in the stroke number columns are adjacently arrayed so that the space can be efficiently used without excess or deficiency. The rightmost column of the stroke number columns 162 is segmented into total columns 164 containing the total number of strokes for the four holes.

At the top of the right segment 156 on the sheet 152, columns 165 are provided to display respective holes as in the left segment 155, and the total numbers of strokes in the IN and OUT courses are displayed together with the handicap values 168 and individual orders.

Below the reference stroke number columns 170, each player's individual stroke number columns 171 are provided to display a plurality of sets of numbers 172 displayed based on the reference numbers of strokes.

Under the right and left segments 155 and 156, the player's signature column 173 and stroke number confirmer name column 174 are provided.

According to the present invention, a golf course that can be easily formed on and used in an existing athletic facility enables golf to be played in areas with limited space through the use of a special golf ball with limited flight distance characteristics and greens formed of resilient materials that limit ball bounce and travel and which also enable the physically handicapped to play golf as wheelchairs will not cause ruts. Moreover, since the artificial turf used for the greens is properly tensioned, it will not wrinkle or buckle due to expansion and contraction caused by seasonal or diurnal temperature variations. In addition, a golf club with two club heads formed at both ends of the shaft, a golf ball with limited flight characteristics, and a golf tee that allows the player to easily hit golf balls has resulted in a golf course that enables players to enjoy golf in all weathers in built-up areas.

FIGS. 31A, 31B, 31C, 32A, 32B, 33A, 33B, 34A, and 34B show the configurations of the S-shaped fasteners used when a primary rectangular portion 10*b* of the artificial turf belt 10 is applied to the base layer 8 when the green shown in FIG. 3B is produced.

Figure 31A:
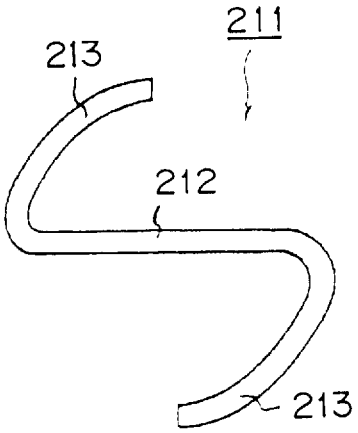
FIG. 31A is a plan view of the S-shaped fastener.
Figure 31C:
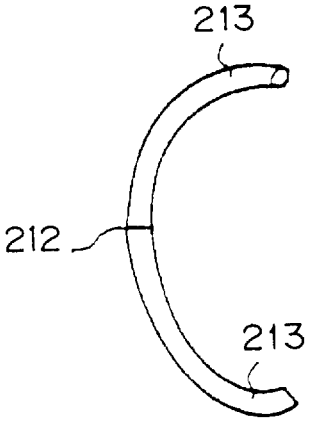
FIG. 31C is a right side view of the S-shaped fastener shown in FIG. 31A.
Figure 31B:
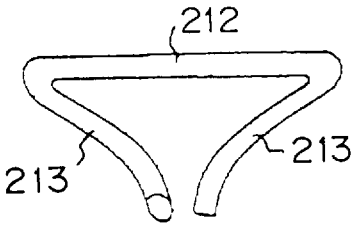
FIG. 31B is a front view of the S-shaped fastener shown in FIG. 31A.

FIG. 31A is a plan view of an S-shaped fastener. FIG. 31B is a front view of the S-shaped fastener. FIG. 31C is a right side view of the S-shaped fastener. In each of the figures, an S-shaped fastener 211 has a supporter 212, and legs 213 are extended to both sides of the supporter 212. The legs 213 are formed in a way that they are extended forming an arc downward from both ends of the supporter 212 to the tip of the legs 213. The tips of the legs 213 are positioned at the portion 90° transposed from the horizontal axis of the supporter 212. The legs are formed with the tips tapered so that the tips of the legs 213 are smoothly moved into the base layer when the supporter 212 is pushed while being turned clockwise using a hand tool. The S-shaped fastener 211 in this example is formed by a stainless steel wire of about 2 mm in diameter, and the length of the supporter 212 is set to about 26 mm. The distance between the center of the supporter 212 to the tip of the legs 213 is set to about 28 mm. However, the dimension, shape, etc. can be formed to vary with necessity. Although the legs 213 are extended clockwise, they can be formed to be extended counterclockwise for convenience of a left-handed user. The S-shaped fastener 211 can be iron, stainless steel, brass, German silver, and any other anticorrosive alloy including amorphous alloy (shape-stored alloy).

Figure 32A:
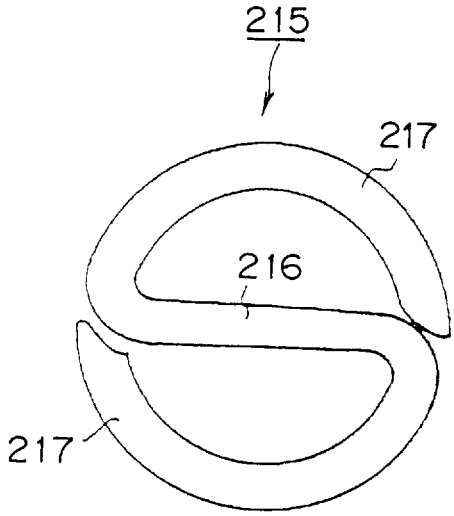
FIG. 32A is a plan view of another example of the S-shaped fastener.
Figure 32B:
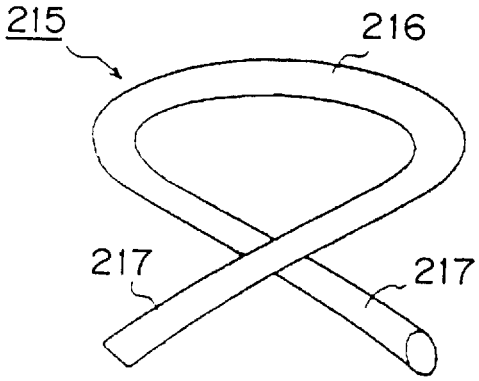
FIG. 32B is a front view of the S-shaped fastener shown in FIG. 32A.
Figure 33A:
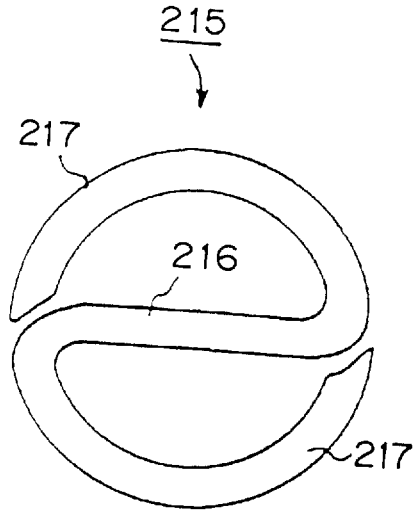
FIG. 33A is a plan view showing an example of an S-shaped fastener formed in a way that, unlike the S-shaped fastener shown in FIG. 32A, the legs are rotationally extended counterclockwise.
Figure 33B:
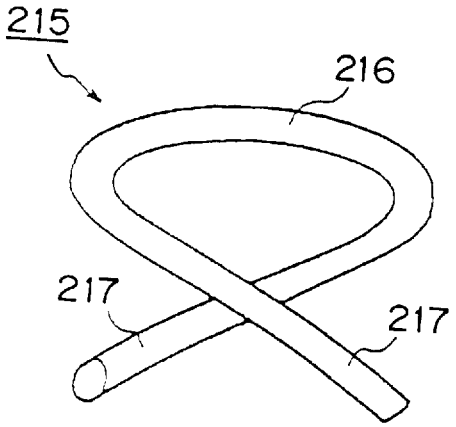
FIG. 33B is a front view of the S-shaped fastener shown in FIG. 33A.

FIG. 32A is a plan view showing another example of an S-shaped fastener. FIG. 32B is a front view of the S-shaped fastener. In each of the figures, an S-shaped fastener 215 has a supporter 216, and legs 217 are extended to both sides of the supporter 216. The legs 217 are formed in a way that they are extended forming an arc downward from both ends of the supporter 216 to the tip of the legs 217. The tips of the legs 217 are positioned at the portion 180° transposed from the horizontal axis of the supporter 216. The legs are formed with the tips tapered so that the tips of the legs 217 are smoothly moved into the base layer when the supporter 216 is pushed while being turned clockwise using a hand tool. The S-shaped fastener 215 in this example is formed by a stainless steel wire of about 3 mm in diameter, and the length of the supporter 216 is set to about 40 mm. The distance between both ends of the supporter 216 to the tip of the legs 217 is set to about 32 mm. However, the dimension, shape, etc. can be formed to vary with necessity. Although the legs 217 are extended clockwise, they can be formed to be extended counterclockwise for convenience of a left-handed user as shown in FIGS. 33A and 33B. The S-shaped fastener 215 can be iron, stainless steel, brass, German silver, and any other anticorrosive alloy including amorphous alloy (shape-stored alloy).

Figure 34A:
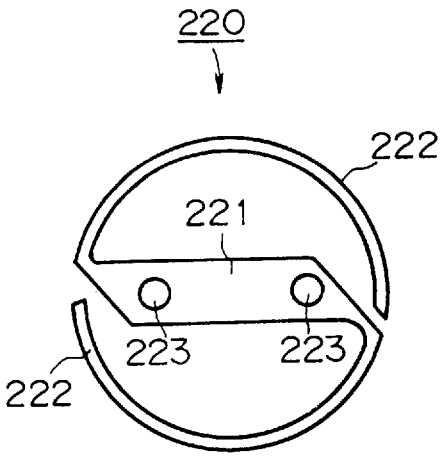
FIG. 34A is a plan view showing another example of an S-shaped fastener.
Figure 34B:
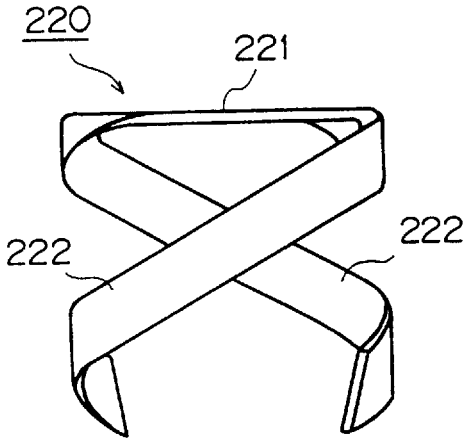
FIG. 34B is a front view of the S-shaped fastener shown in FIG. 34A.

FIG. 34A is a plan view showing another example of an S-shaped fastener. FIG. 34B is a front view of the S-shaped fastener. In each of the figures, an S-shaped fastener 220 has a supporter 221, and legs 222 are extended to both sides of the supporter 221. The legs 222 are formed in a way that they are extended forming an arc downward from both ends of the supporter 221 to the tip of the legs 222. The tips of the legs 222 are positioned at the portion 180° transposed from the horizontal axis of the supporter 221 similarly as shown in FIG. 32B. However, the S-shaped fastener 211 can be made of, for example, stainless steel plate of about 8 mm in width, and the tips of the legs 222 are tapered at an angle of 45 degrees. A hole 223 of about 4 mm in diameter is provided at the position 10 mm off the center of the supporter 190. When the artificial turf is applied to the base layer, a screw pole having a sharp thread is inserted through the hole 223 to fix the S-shaped fastener 220. When the plate forms the S-shaped fastener, amendments can be made in accordance with the above described explanation.

The above described S-shaped fastener is used as follows. A hole through which the leg of the S-shaped fastener is inserted is made at the position where the S-shaped fastener is fixed onto the artificial turf laid on the base layer 8 through the thin layer 9 of foam polyurethane. A thread of a hand tool (having a thread at one end for holding the supporter of the S-shaped fastener, and having a handle at the other end) is met with the supporter of the S-shaped fastener. The handle of the hand tool is held and pushed while turning the hand tool to insert the leg of the S-shaped fastener into the base layer and to fix the artificial turf between the base layer and the supporter of the S-shaped fastener.

What is claimed is:

1. A golf course, comprising:

greens, wherein said greens include:

impermeable artificial turf;

a thin, resilient layer that absorbs shock wherein said thin, resilient layer responds flexibly to an external force and returns to its original dimension when the external force is removed so as to reduce golf ball bounce and hence roll on the said artificial turf, said thin, resilient layer being disposed below the said artificial turf and composed of a sponge-like tissue, plastic foam, or sponge rubber;

a buffer disposed below said thin, resilient layer, said buffer being composed of polyethylene foam or polypropylene foam;

a plate member disposed below said buffer;

a boundary edge portion formed of an inversely disposed groove member in the periphery of said artificial turf, the groove member having an inner groove member, the inner groove member being secured to said plate member; and elastic members positioned in the vicinity of the periphery of said artificial turf, the ends of each of said elastic members being secured to the inner groove member.

2. A golf course as in claim 1, wherein said thin resilient layer is urethane foam;

said buffer comprises polyethylene foam;

said elastic members are composed of springs, rubber, soft plastic, or similar elastic materials; and a bunker or dummy pond comprising differently colored artificial turf sheets being adhered together is provided, said bunker or dummy pond being formed of inverted sheets of said artificial turf.

3. A golf course as in claim 1, wherein:

said elastic members positioned in the vicinity of the periphery of said artificial turf tension said periphery.

4. A golf course of claim 3, wherein said elastic members are composed of springs, rubber, or soft plastic.

5. A golf course as in claim 1, wherein:

said buffer is shock absorbent and deformation resistant; and said elastic members positioned in the vicinity of the periphery of said artificial turf tension said periphery.

6. A golf course as in claim 1, wherein:

said buffer has shock absorbing and deformation resistant characteristics;

said boundary edge portion is formed of an artificial turf belt disposed at the periphery of said artificial turf; and said elastic members positioned in the vicinity of the periphery of said artificial turf tension said periphery.

7. A golf course as in claim 1, wherein said plate member comprises aluminum, steel or wood.

8. A golf course comprising:

a impermeable artificial turf;

a thin member of a sponge-structured or foam-structured plastic or sponge rubber material applied under said artificial turf to reduce bouncing of a golf ball rolling on the artificial turf, wherein said thin member responds flexibly to an external force and returns to its original dimension when the external force is removed;

a buffer of foam material under said thin member, wherein said buffer responds flexibly to an external force and returns to its original dimension when the external force is removed;

elastic members positioned in the vicinity of the periphery of said artificial turf tensioning said periphery, said elastic members being composed of springs, rubber, soft plastic, or similar elastic material, and a boundary member of resilient material positioned over said elastic members and around said artificial turf, wherein said boundary member has a plurality of regularly spaced grooves adapted to prevent wrinkling of said boundary member when applied against a curved surface or from the influence of temperature or moisture.

9. A golf course of claim 8 wherein said buffer is foam polyethylene or foam polypropylene.

10. A golf course of claim 8 wherein said boundary member of resilient material is a rubber, or soft plastic.

11. A golf course according to claim 8, wherein said boundary member of resilient material comprises a plurality of rectangular portions and a plurality of triangular shaped portions, said triangular shaped portions being adapted to be positioned in and to fill V-shaped gaps formed when said rectangular portions are applied along a curved edge of said artificial turf.

12. An artificial golf green, comprising:

impermeable artificial turf having an inversely disposed groove in the periphery thereof, and having an inner groove member;

a thin resilient layer that absorbs shock so as to reduce golf ball bounce and hence roll on said artificial turf, wherein said resilient layer responds flexibly to an external force and returns to its original dimension when the external force is removed, said thin resilient layer being disposed below said artificial turf and composed of a sponge-like tissue, plastic foam, or sponge rubber;

a buffer disposed below said thin layer, said buffer comprising polyethylene foam or polypropylene foam;

a plate member disposed below said buffer;

said inner groove member being secured to said plate member;

elastic members positioned in the vicinity of the periphery of said artificial turf tensioning said periphery, the ends of each of said elastic members being secured to the inner groove member; and a boundary edge portion formed to interact with said inversely disposed groove member in the periphery of said artificial turf.

13. An artificial golf green according to claim 12, wherein:

said thin resilient layer is urethane foam;

said elastic members are composed of springs, rubber, soft plastic, or similar elastic materials; and a dummy sand trap or dummy pond comprising differently colored inverted artificial turf sheets is provided.

14. An artificial golf green according to claim 12, wherein said elastic members comprise springs, rubber, or soft plastic.

15. An artificial golf green according to claim 12, wherein:

said buffer is shock absorbent and deformation resistant.

16. An artificial golf green according to claim 12, wherein said boundary edge portion comprises a plurality of rectangular portions and a plurality of triangular shaped portions of resilient material, said triangular shaped portions being adapted to be positioned in and to fill V-shaped gaps formed when said rectangular portions are applied along a curved edge of said artificial turf.

17. An artificial golf green according to claim 12, wherein said plate member comprises aluminum, steel or wood.

* * * * *